US010741025B2

(12) United States Patent
Perea-OcHoa

(10) Patent No.: US 10,741,025 B2
(45) Date of Patent: Aug. 11, 2020

(54) METHOD AND SYSTEM OF OPERATING MULTI-TASK INTERACTIVE ELECTRONIC DEVICES

(71) Applicant: Jesus Perea-OcHoa, Montebello, CA (US)

(72) Inventor: Jesus Perea-OcHoa, Montebello, CA (US)

( * ) Notice: Subject to any disclaimer, the term of this patent is extended or adjusted under 35 U.S.C. 154(b) by 0 days.

(21) Appl. No.: 15/921,674

(22) Filed: Mar. 15, 2018

(65) Prior Publication Data

US 2018/0204416 A1 Jul. 19, 2018

Related U.S. Application Data

(63) Continuation-in-part of application No. 15/096,238, filed on Apr. 11, 2016, which is a continuation-in-part of application No. 12/924,651, filed on Sep. 30, 2010, now abandoned.

(51) Int. Cl.

| | |
|---|---|
| ***A63F 9/00*** | (2006.01) |
| ***G07F 17/32*** | (2006.01) |
| *A63F 1/00* | (2006.01) |
| *A63F 3/00* | (2006.01) |

(52) U.S. Cl.

CPC ..... *G07F 17/3272* (2013.01); *G07F 17/323* (2013.01); *G07F 17/3209* (2013.01); *G07F 17/3211* (2013.01); *G07F 17/3218* (2013.01); *G07F 17/3239* (2013.01); *G07F 17/3241* (2013.01); *G07F 17/3251* (2013.01); *G07F 17/3276* (2013.01); *G07F 17/3293* (2013.01); *A63F 2001/008* (2013.01); *A63F 2003/00996* (2013.01)

(58) Field of Classification Search

None

See application file for complete search history.

(56) References Cited

U.S. PATENT DOCUMENTS

| | | | | |
|---|---|---|---|---|
| 9,891,965 | B2 * | 2/2018 | Hong | G06F 9/542 |
| 2002/0183105 | A1 * | 12/2002 | Cannon | G07F 17/32 463/16 |
| 2006/0035707 | A1 * | 2/2006 | Nguyen | G07F 17/32 463/29 |
| 2007/0167209 | A1 * | 7/2007 | Jaffe | G07F 17/32 463/16 |
| 2007/0270224 | A1 * | 11/2007 | Abbott | G07F 17/32 463/42 |
| 2008/0076572 | A1 * | 3/2008 | Nguyen | G07F 17/32 463/42 |

(Continued)

*Primary Examiner* — Seng H Lim

(74) *Attorney, Agent, or Firm* — Raymond Y. Chan; David and Raymond Patent Firm

(57) ABSTRACT

An arrangement of operating multi-task interactive electronic devices includes at least one processor, a screen module and two or more input modules. The processor executes at least a first application and a second related application with different interactive programs at the same time. The screen module is operatively linked to the processor. The screen module comprises at least a display screen having two or more display areas two or more applications thereon respectively. Two or more input modules are operatively linked to the processor, wherein the applications are able to be simultaneously controlled and operated by the input modules respectively.

27 Claims, 20 Drawing Sheets

(56) References Cited

U.S. PATENT DOCUMENTS

2008/0119276 A1* 5/2008 Alderucci ..... G07F 17/32 463/42
2008/0200225 A1* 8/2008 Walker ..... G07F 17/32 463/7
2009/0176558 A1* 7/2009 Englman ..... G07F 17/32 463/25
2009/0176559 A1* 7/2009 Buchholz ..... G07F 17/32 463/25
2009/0247285 A1* 10/2009 Gagner ..... G07F 17/32 463/25
2009/0318220 A1* 12/2009 Arezina ..... G06Q 20/24 463/25
2010/0182265 A1* 7/2010 Kim ..... G06F 1/1616 345/173
2011/0047459 A1* 2/2011 Van Der Westhuizen ..... G06F 1/1692 715/702
2012/0139815 A1* 6/2012 Aono ..... G06F 1/1616 345/1.3
2012/0157199 A1* 6/2012 Nord ..... G07F 17/3225 463/31
2013/0002595 A1* 1/2013 Asagi ..... G06F 1/1647 345/173
2013/0065686 A1* 3/2013 LeMay ..... G07F 17/32 463/37
2013/0332881 A1* 12/2013 Yook ..... G06F 3/0481 715/781
2014/0089833 A1* 3/2014 Hwang ..... G06F 3/04817 715/769
2014/0101576 A1* 4/2014 Kwak ..... G06F 3/0482 715/761
2015/0067579 A1* 3/2015 Jeong ..... G06F 3/0488 715/781
2015/0121229 A1* 4/2015 Wang ..... G06F 3/0484 715/728
2015/0121300 A1* 4/2015 Wang ..... G06F 3/04845 715/790
2015/0121302 A1* 4/2015 Wang ..... G06F 9/451 715/800
2015/0185980 A1* 7/2015 An ..... G06F 3/0482 715/803
2015/0186024 A1* 7/2015 Hong ..... G06F 9/542 715/800
2015/0286344 A1* 10/2015 Kaufthal ..... G06F 3/0481 715/768
2016/0011776 A1* 1/2016 Song ..... G06F 3/04886 345/156

* cited by examiner

METHOD AND SYSTEM OF OPERATING MULTI-TASK INTERACTIVE ELECTRONIC DEVICES

CROSS REFERENCE OF RELATED APPLICATION

This is a Continuation-In-Part application that claims the benefit of priority under 35 U.S.C. § 120 to a non-provisional application, application Ser. No. 15/096,238, filed Apr. 11, 2016, which is a Continuation-In-Part application that claims the benefit of priority under 35 U.S.C. § 120 to a non-provisional application, application Ser. No. 12/924,651, filed Sep. 30, 2010, the entire contents of each of which are expressly incorporated herein by reference.

BACKGROUND OF THE PRESENT INVENTION

Field of Invention

The present invention relates to a method and arrangement of operating electronic device, and more particularly to method and arrangement of operating multi-task interactive electronic devices for playing games, such as a card game, or processing softwares or applications in electronic devices between two or more people through a communication network in a real-time manner.

Description of Related Arts

The games, such as casino or gambling games and video games, are dramatically popular for entertainment people nowadays. The games usually have the basic rules, so that the players play the game with the strategies based on the rules. Some of the gambling type games are designed for people betting against each other, such as poker; the other games are designed for the player wagering against the dealer.

The reality games in casino generally being played by the following two methods. One of the main types of gambling games is the table games. These types of games usually require one or more players physically gather together on a specific designed gambling table, wherein there may have at least one dealer to host the gambling game, so that the players are able to wager against the house. On the other hands, the players may also gather together at the gambling table for playing against each other, such as Texas Hold'em poker game, and one of the players can be the dealer of the game when he or she meets the agreed requirements. However, during the peak gambling time in the casino, all the tables of the table games may be crowded and full of players, so that it is hard to get a spot for playing the game. The player may have to wait in line in order to play. It is time consuming and tiring for the gamblers.

In addition, most casinos require a certain dress code policy that delineates what should be the acceptable and appropriate standard of dress and personal appearance of the players. For example, the player may not be able to wear pajama to play the table game when he or she stays in the hotel room. Therefore, he or she may not want to leave the hotel room at all. Disable people or seniors may not able to travel long distance in order to play the table game. Furthermore, privacy is also limited some high profiled clients who will stay away from the game.

The other main types of the games in casino are the machine type games, such as electronic gaming machines, which may include slot machines or roulettes. Take the roulette for example, the display panel of the machine may have a virtual roulette spinning wheel, wherein after the player betting on the desired numbers, colors, or odd or even of the numbers, the player can push a bottom to spin the virtual wheel to randomly generate the numbers, so as to determine the winning or losing of the player. In general, the player is wagering against the machine when he or she chooses to play the machine type games. Therefore, the virtual games of the gambling machines are unable to provide the gamblers the fun of betting or playing against other real players. In other words, this type of game is limited to the chatting among players. There is no communication and interaction, sociability among players.

In addition, most electronic devices are powerful enough to run two applications at the same time for multi-tasking. For example, the player is able to play via a game application and chat with friends via another chat application. However, these applications are controlled by one single input. In other words, when the player wants to control the game, he or she must switch the input corresponding to the game application. When the player wants to chat with friends, he or she must switch the input back to the chat application from the game application. This switching manner will interfere the flow of the game and the chatting as well.

Thereby, the current methods for playing games, especially for gambling games in casino, are limited, so that the gamblers or players have not much chooses.

Such switching burden also exists in processing software applications and/or computer languages, such as processing a word or graphic document, by opening one window and chatting with friends with a communication software or APP by opening another window. The user is required to switch between the windows from time to time too. Specially in users with physical medical tremors, it can be severely limiting to operate programs like these that require continues dexterity.

SUMMARY OF THE PRESENT INVENTION

The invention is advantageous in that it provides a method and arrangement of operating multi-task interactive electronic device for playing games through a communication network. Therefore, the player will have a choice of staying in the hotel room, lying at the pool side area, or while lounging to play the game.

Another advantage of the present invention is to provide a method and arrangement of operating multi-task interactive electronic device for playing games or processing softwares or applications such as processing word or graphic documents, in which the user is able to control at least two applications simultaneously by at least two input modules in a real-time manner without interfering the applications.

Another advantage of the present invention is to provide a method and arrangement of operating multi-task interactive electronic devices, including but not limited to augmented reality and virtual reality (AR/VR) devices, working independently or in conjunction with at least an electronic device for playing games or processing softwares or applications such as processing word or graphic documents, in which the user is able to control at least two applications simultaneously by at least two input modules in a real time manner without interfering the applications.

Another advantage of the present invention is to provide a method and arrangement of operating multi-task interactive electronic device(s) for playing games, wherein the players of the game are able to remotely play the selected game while being able to play against one or more of other real players playing through the communication network in a real-time manner.

Another advantage of the present invention is to provide a method and arrangement of playing games or processing softwares or applications such as processing word or graphic documents in an electronic device, wherein the players or users are able to play the games or process the softwares or applications anywhere anytime via remotely linking the individual electronic devices to the communication network.

Another advantage of the present invention is to provide a method and arrangement of playing games, wherein the player is able to set his or her own character and stay at the comfortable location to challenge the opponents in order to the adventure fantasy of the game.

Another advantage of the present invention is to provide a method and arrangement of playing games or processing softwares or applications, wherein the players or users are able to remotely play the game or process the software or application while communicatively chatting with other real players or users through the communication network.

Another advantage of the present invention is to provide an arrangement of operating multi-task interactive electronic devices for playing games, wherein the communication network of the casino is able to link to a plurality of individual electronic devices, such as slot machines, electronic roulettes, and electronic poker games, so that the players are able to remotely bet or play the gambling game against another real player and/or the dealer, which may be the machine, via the individual electronic devices through the communication network. Therefore, the players have no need to physically go to the crowded gambling table of the table type games or sit in front of the machines while being able to play against the real players.

Another advantage of the present invention is to provide a method and arrangement of operating multi-task interactive electronic devices for playing game, wherein the player is able to active a sideline program for operating multi-task while interacting with one or more electronic devices by inputting membership information such as by inserting a membership card which may digitally store the player information and the prepaid money therein or by means of face or fingerprint recognition to verify the player's information and open the player's prepaid money account stored in the central control of the host of the game, such as the casino, for actuating the games. Thereby, the arrangement may also eliminate the precisely and accurately counting process of physical cash or betting chips after each round of the betting or wagering of the game, so as to enhance the security of the casino and players. Accordingly, the arrangement will be designed primarily for the use of the guest of an establishment such as a hotel. Gambling atmosphere will be fully provided for the establishment guest to play the game anywhere.

Another advantage of the present invention is to provide a method and arrangement of operating multi-task interactive electronic device(s) for playing game, wherein the information of the player, including credit card information and personal information, will be encrypted and stored, such tokenization, for enhancing the data security.

Additional advantages and features of the invention will become apparent from the description which follows, and may be realized by the following description of the instrumentalities and combinations particular pointing out in the appended claims.

According to the present invention, the foregoing and other objects and advantages are attained by providing an arrangement of playing games, comprising:

a plurality of individual electronic devices for being activated by at least one player of the game to controllably and selectively play games therethrough; and a networking system electrically linking to each of the individual electronic devices and being accessible by at least one casino for managing the arrangement of playing games, wherein the communication network system comprises:

a communication network, which comprises an information storage for storing at least one of the player's information therein, and a plurality of game programs stored in the communication network; and a remote connecting module for electrically linking the individual electronic devices with the communication network to form the networking system, so that when the player controllably activates the individual electronic device in an authorized manner to electrically link the communication network through the remote connecting module, the player is able to play the casino games in a remotely gambling manner.

In one embodiment, the game players may activate the individual electronic devices by inputting a membership information, for example, via a membership card provided by the casino, so that when the membership card is electrically connected to the individual electronic device to authorize the player accessing the computer program for the communication network of the casino, the player is able to selectively play the games for betting or wagering.

In one embodiment, the communication network further comprises an online chatting program electrically linking with the remote connecting module, so that the players are able to remotely play the games against or with other real players while being able to chat with other players in a real-time manner. Therefore, the arrangement of playing game does not require the players physically go to the gambling table, and meanwhile, provides the players remotely play against or with other real players in a real-time manner.

In one embodiment, the communication network may be wirely or wirelessly linked to the individual electronic device in the remote control manner. In other words, the individual electronic devices are able to access communication network remotely, preferably, within a predetermined distance.

In accordance with another aspect of the invention, the present invention provides a method of operating multi-task interactive electronic devices for playing games or processing softwares or applications, which comprises the steps of:

(a) providing a plurality of individual electronic devices, such as notebook, tablet, smart device, cellular phone, portable computer, image capturing device, voice capturing device, motion sensing device, augmented reality (AR) device, and/or virtual reality (VR) device, installed with a sideline program for operating multi-task interaction for a plurality of players respectively for playing games via each of the individual electronic devices; and (b) remotely linking the individual electronic devices to a networking system, wherein the networking system comprises a communication network having a remote connecting module to electrically connect the individual electronic devices with the networking system in a remotely connection manner, and a central control device for managing the networking system.

In accordance with another aspect of the invention, the present invention provides an electronic device for playing games or processing softwares or applications, comprising:

a processor that executes at least a first task application and a second related task application with different interactive programs at the same time;

a screen module operatively linked to the processor, wherein the screen module comprises a display screen having two or more display areas for displaying the first application and the second related application thereon respectively; and two or more input modules operatively linked to the processor, wherein the first application and the second related application are simultaneously controlled by the input modules respectively, such that the first application and the second related application are executed to be displayed on the display areas respectively and are independently controlled by the input modules at the same time for enabling a user to play a game of the first application via one of the input modules and operate the second related application at the same time via the another input module without interfering the first application.

In one embodiment, the electronic device further comprises a control module operating a sideline program to generate one or more sidelines displayed on the display screen to split the display screen into the two or more display areas.

In one embodiment, at least one of the sidelines is generated as one of a horizontal sideline and a vertical sideline being movable on the display screen to split the display screen into the two or more display areas and to adjust a size of each of the display areas.

In one embodiment, the electronic device of the present invention further provides a control module which comprises a color code generator that generates different color codes for the one or more sidelines to indicate the different interactive programs of the game related application. It is also important to note that each of the sidelines is able to be controlled by voice command and audible.

In one embodiment, a control panel of the electronic device of the present invention is coupled at the display screen, wherein the input modules are provided at the control panel to independently control the first application and the second related application displayed on the display areas of the display screen.

In one embodiment, at least a visual sideline is slidably formed and displaced at the display screen of the electronic device of the present invention to separate the first application and the second related application displayed on the display areas respectively and at least another control sideline is slidably formed and displayed at the control panel to separate the input modules thereon.

In one embodiment, at least one of the input modules is automatically selected to match with the first application and at least one of the input modules is manually selected by the user to match with the second related application.

In one embodiment, the electronic device of the present invention further includes a phone connection station for connecting with a user smart phone of the user, wherein the verification module comprises a verification program application to generate a verification code in order to activate the electronic device and also to executed the user smart phone settings and preferences down to the electronic device automatically.

In one or more embodiments, the electronic device of the present invention supported by the sideline program to provide the sideline(s) at the display screen and/or the control panel is embodied as an innovative portable electronic device, a traditional notebook, tablet or smart device, an AR device, a VR device, or AR/VR device.

In one embodiment, the communication network used by the electronic device of the present invention is a closed communication network module being executed by the processor for wirelessly linking to a private networking system, wherein the first application is restricted for being accessed only through the private networking system.

In one embodiment, the electronic device of the present invention further includes a positioning unit for detecting a location of the electronic device, such as notebook, smart device, tablet, portable computer, AR device, VR device, or AR/VR device, wherein the electronic device will be disable for being outside a facility perimeter area in a real time manner via the positioning unit.

In one embodiment, the electronic device of the present invention further includes a chatting module, wherein the second related application comprises a chatting application being executed for enabling the user to chat with another user of another portable electronic device via the chatting module when the users play or process the same first application.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
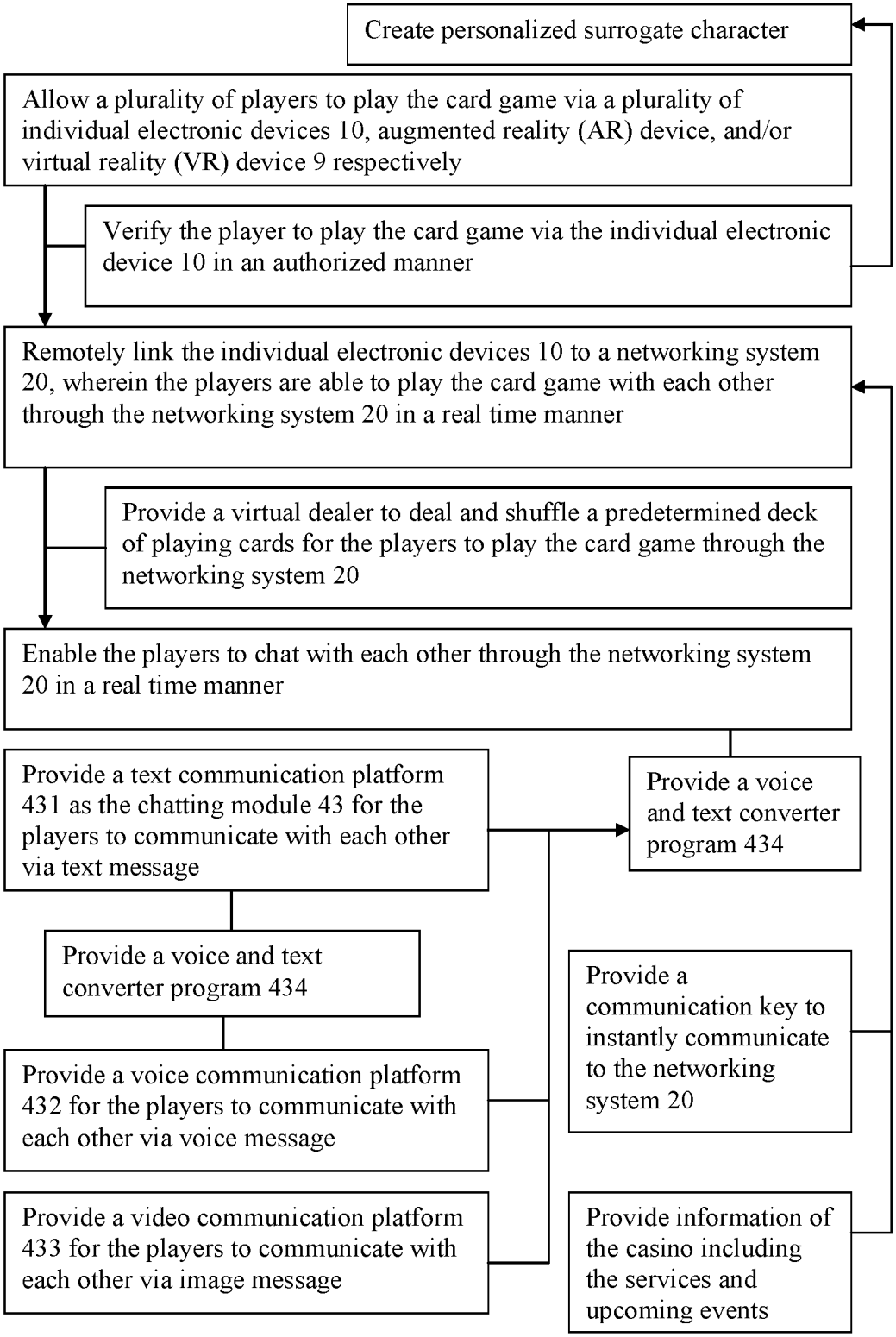
FIG. 1 is a flow chart of a method of playing games according to a preferred embodiment of the present invention.

Referring to FIG. 1 of the drawing, a method of operating an electronic device for playing games, especially for card games, according to a preferred embodiment of the present invention is provided, wherein the method comprises the steps as below.

(a) Allow a plurality of players to play at least a game or process at least a software or application via a plurality of individual electronic devices 10 respectively.

(b) Remotely link the individual electronic devices 10 to a networking system 20, wherein the players or users are able to play the same game or process the same software or application with each other through the networking system 20 in a real time manner.

(c) Enable the players to chat with each other through the networking system 20 in a real time manner, wherein the players or users are able to remotely and simultaneously play the game or process the software or application and chat with each other via the individual electronic devices 10 through the networking system 20, such that the networking system 20 forms not only a playing or processing channel for the player or user to play the game or to process the software or application but also a communication channel for the players or users to chat so as to enhance the entertainment of the game or the software or application.

Accordingly, the networking system 20 may further comprise at least a central control 40 for centrally managing the networking system 20. The central control 40 preferably comprises an information storage module 41 for storing a plurality of information of players or users, and a plurality of game, software and/or application programs 42 electrically and digitally stored in the central control 40 for providing variety of games, softwares or applications being remotely and virtually played or processed by the players or users.

Figure 3:
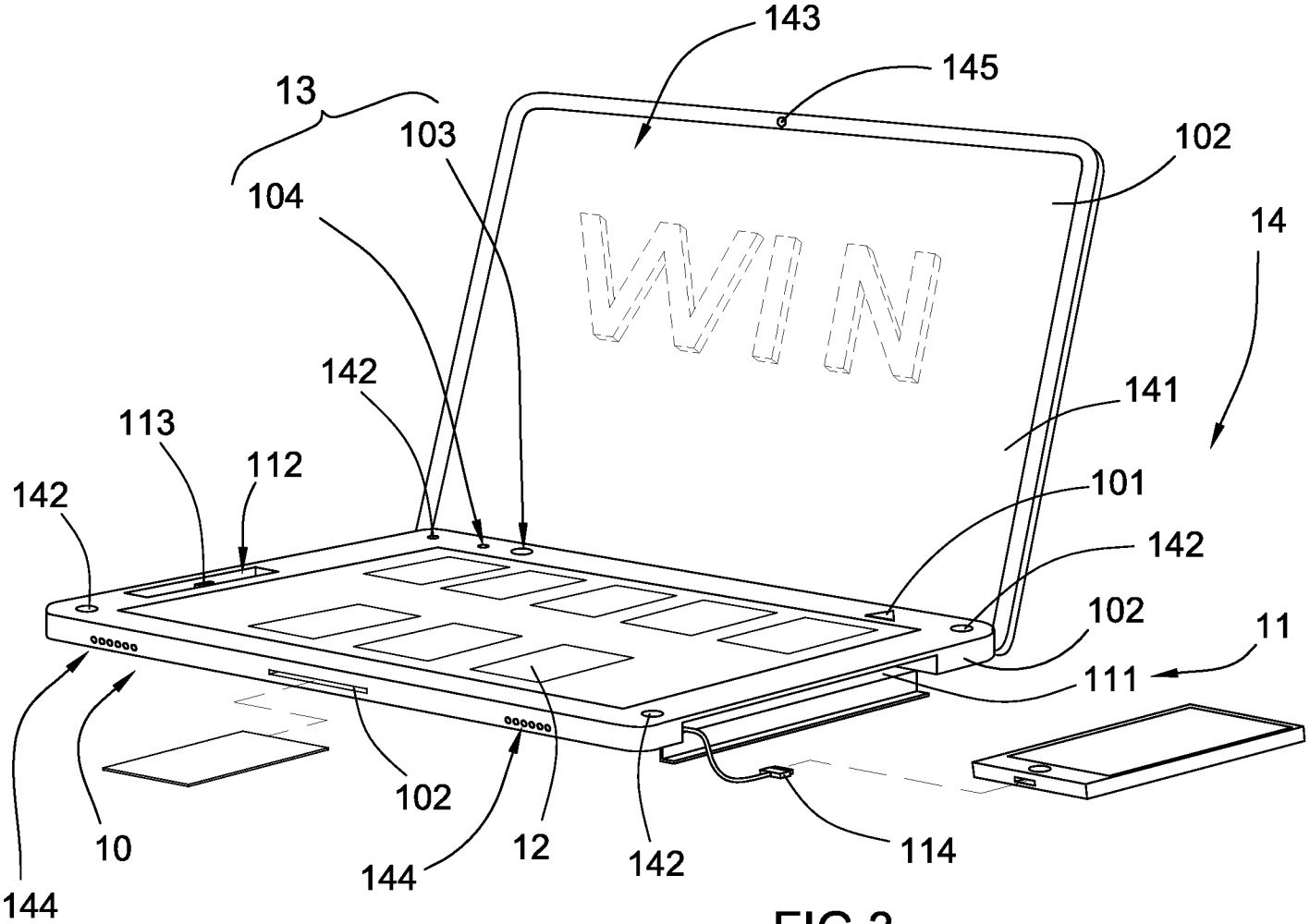
FIG. 3 is a perspective view of the electronic device according to the preferred embodiment of the present invention.
Figure 3A:
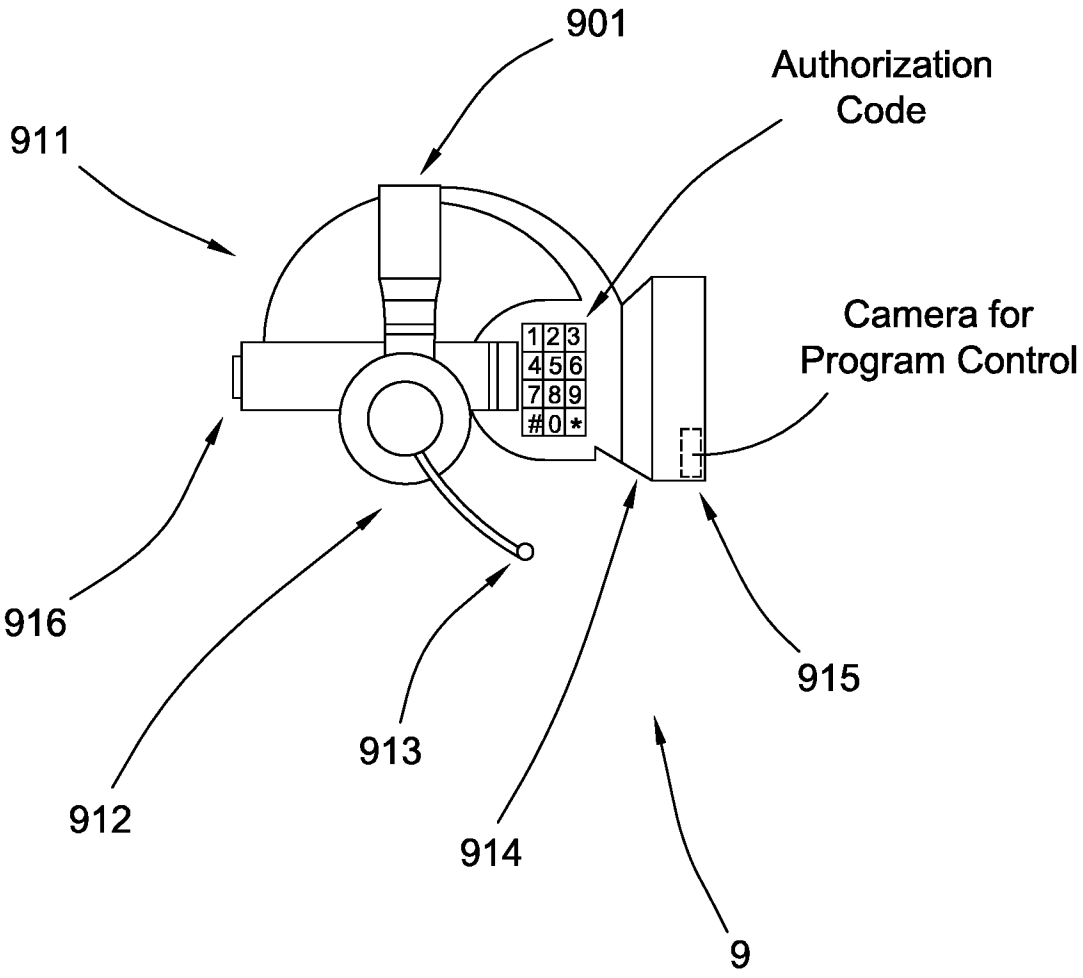
FIG. 3A illustrates an augmented reality and virtual reality (AR/VR) device embodied as the electronic device according to the preferred embodiment of the present invention.
Figure 3B:
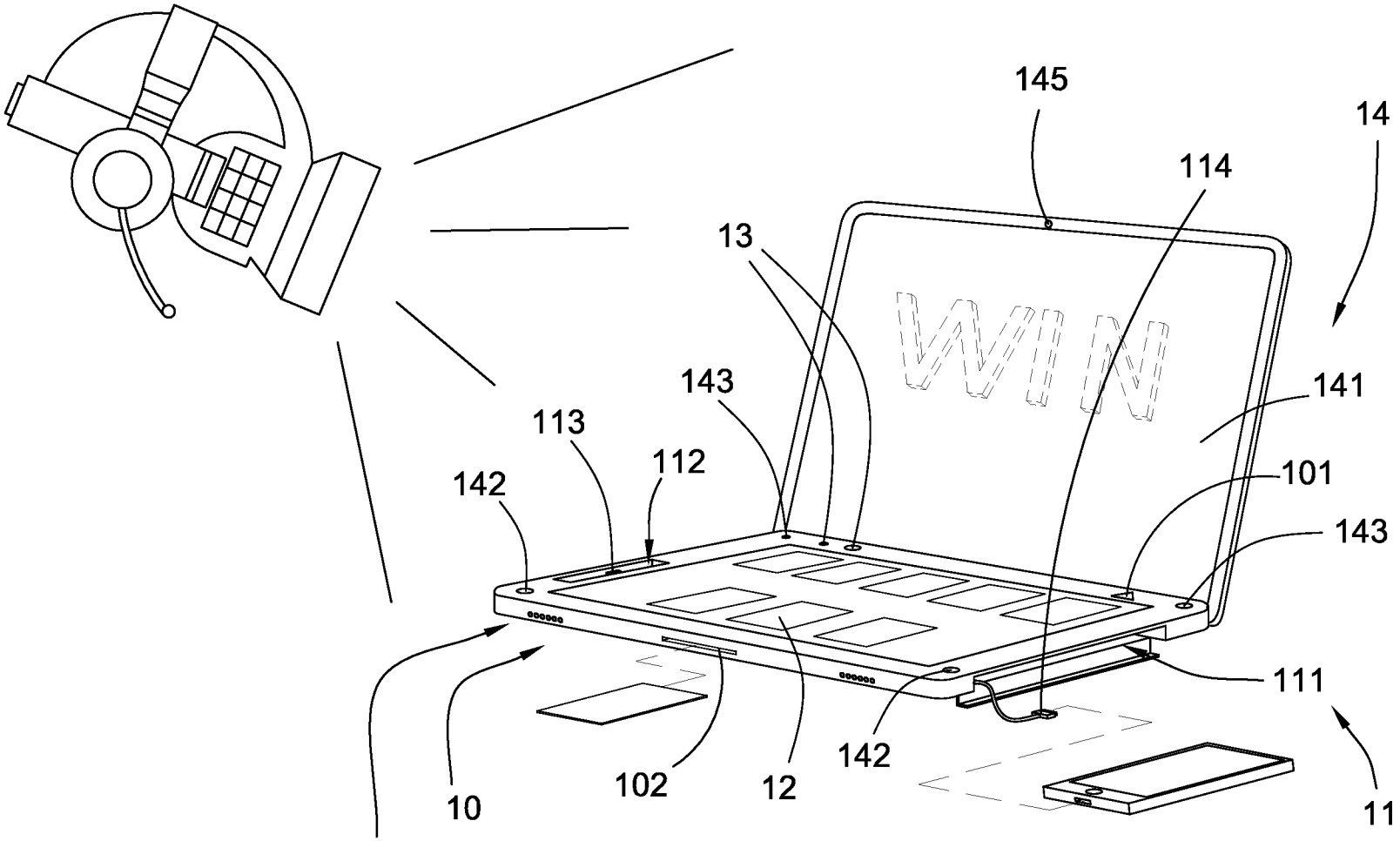
FIG. 3B illustrates the image of the AR/VR operator to be seen in the AR/VR device of the FIG. 3A in relative to the operation and functions according to the preferred embodiment of the present invention.
Figure 5:
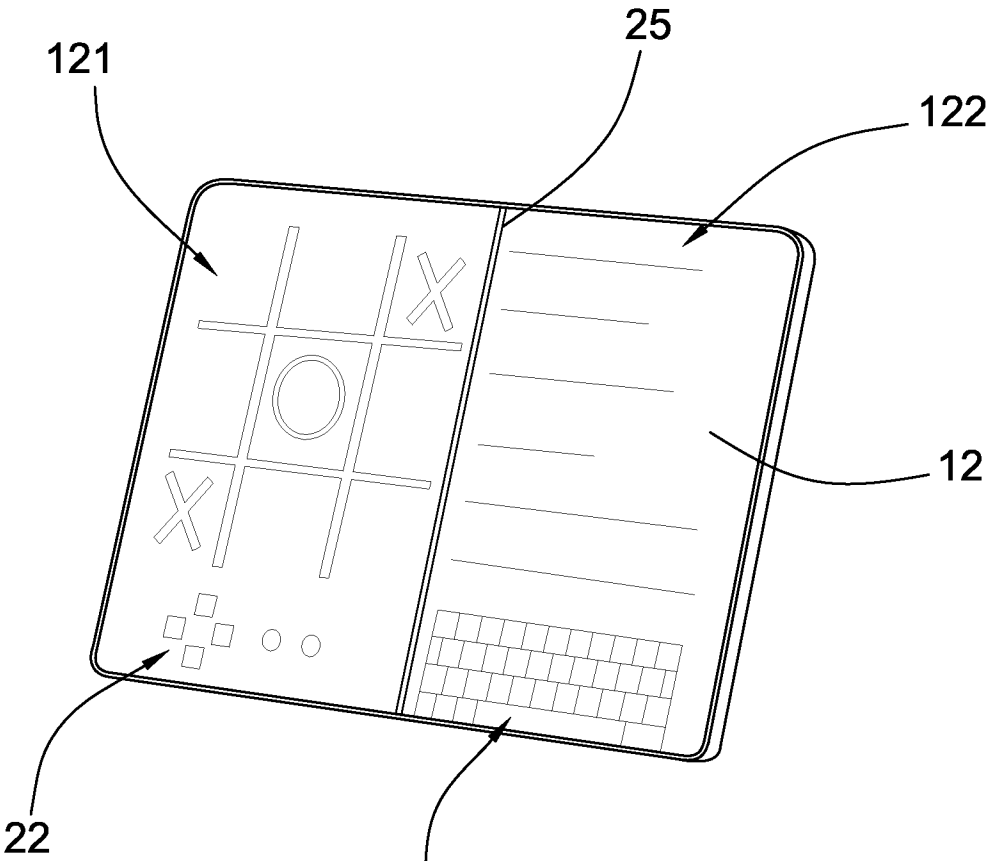
FIG. 5 illustrates the electronic device as a tablet computerized device according to the preferred embodiment of the present invention.
Figure 6A:
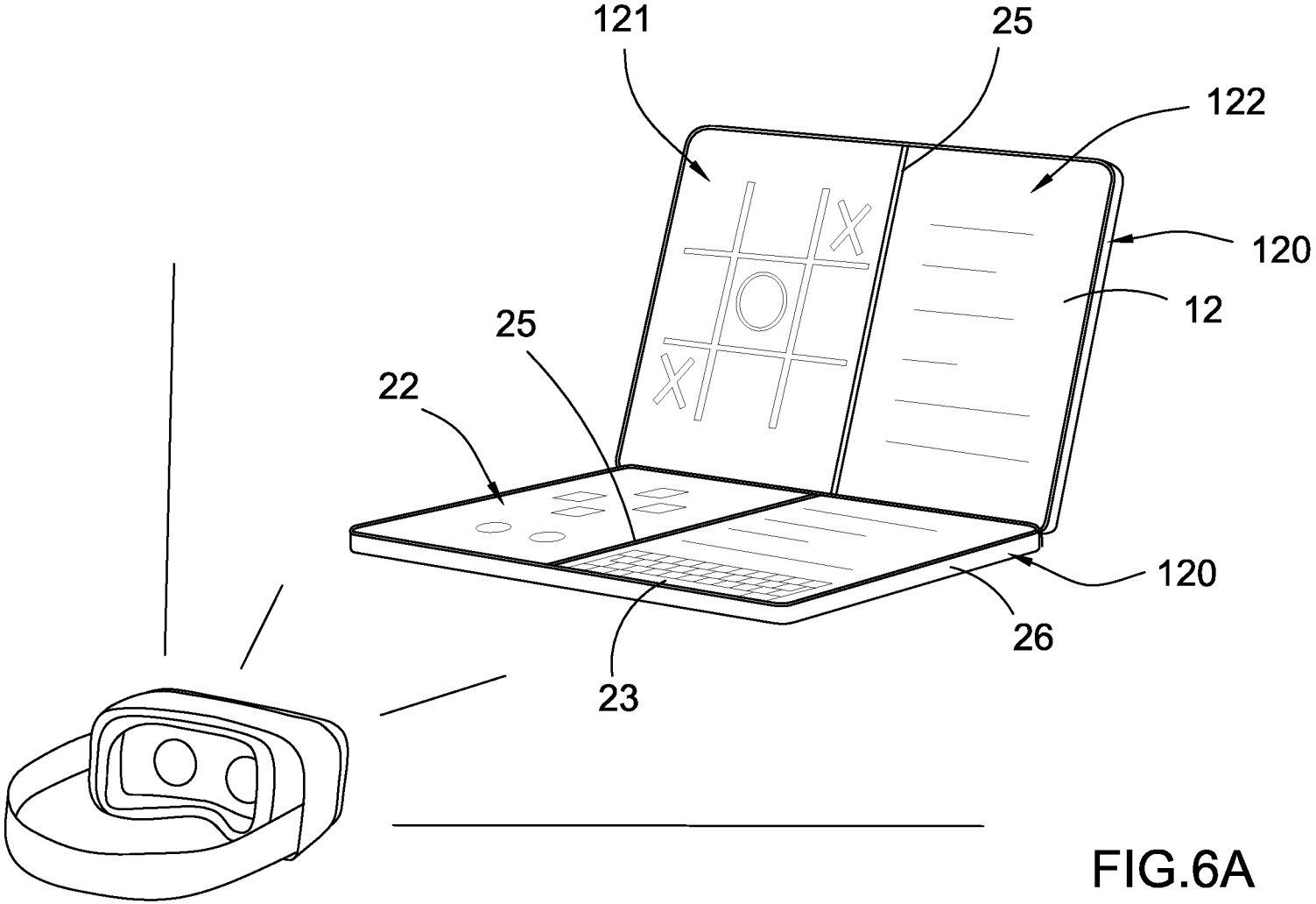
FIGS. 6A to 6C illustrate various settings of the electronic device as a laptop-like computerized device according to the preferred embodiment of the present invention.
Figure 6B:
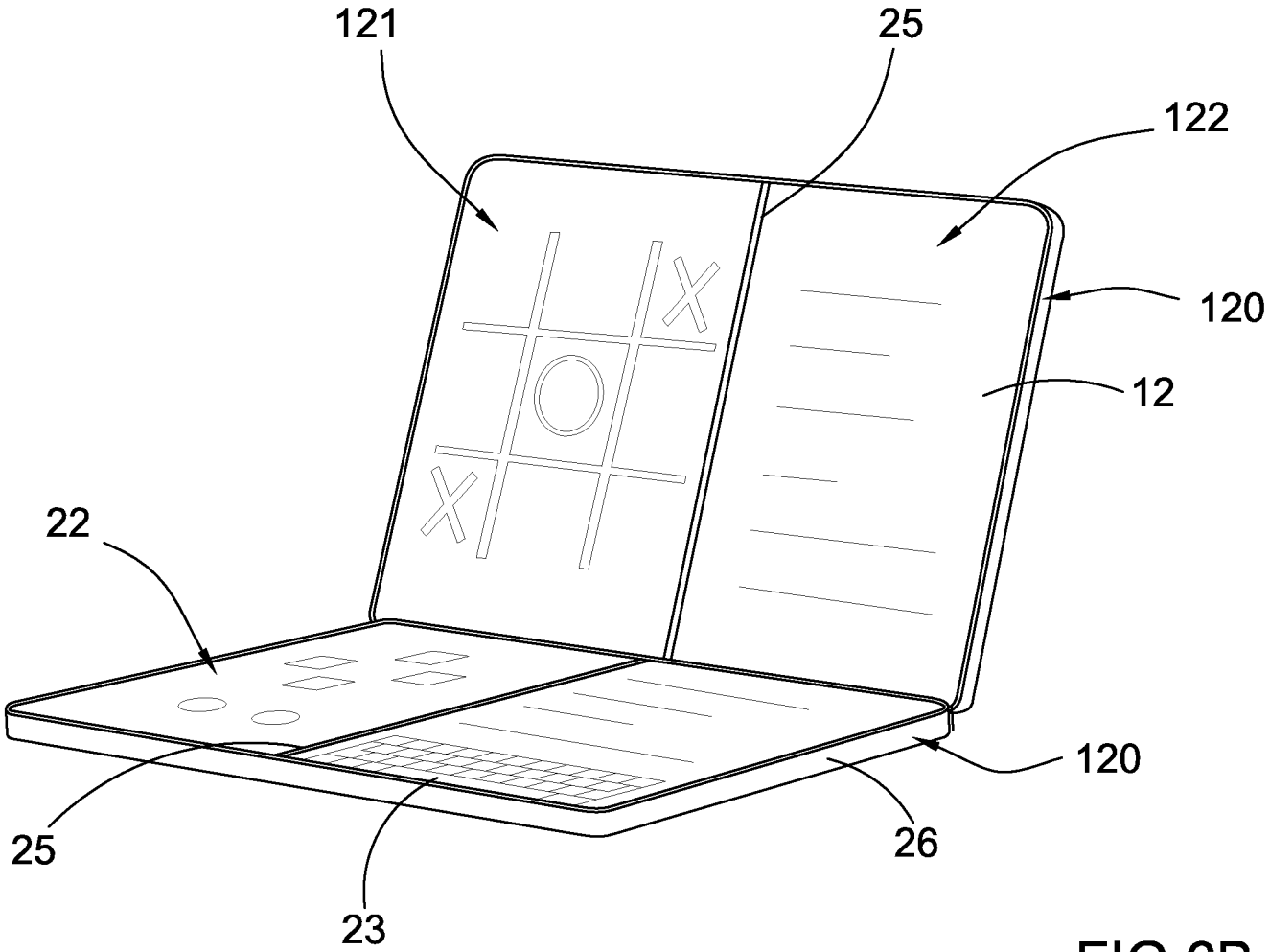
Figure 6C:
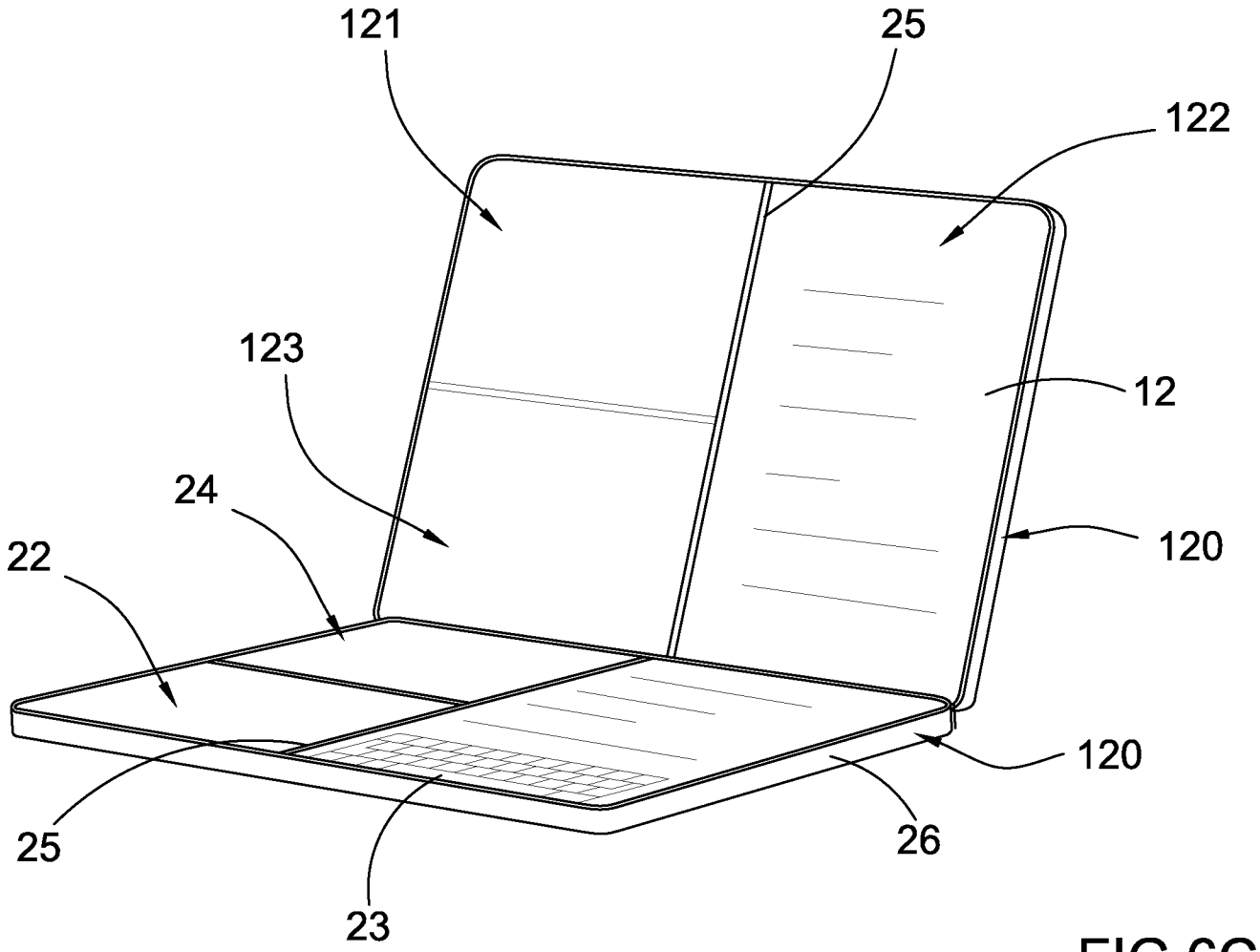

According to the preferred embodiment of the present invention, the electronic devices 10 can be a notebook type electronic device as illustrated in FIG. 3, an augmented reality and virtual reality (AR/VR) device 9 as illustrated in FIGS. 3A and 3B, a tablet type electronic device as illustrated in FIG. 5, an innovative electronic device as illustrated in FIGS. 6A to 6C, and/or any other like electronic device that can be operated with a sideline program to form and display a slidable sideline on the display screen and/or the control panel of the electronic device.

According to the preferred embodiment of the present invention, when the game to play is a gambling game such as card game, the central control 40 remotely linked with the individual electronic devices 10 to form the virtual dealer to deal and shuffle a predetermined deck of playing cards for the players to play the game through the networking system 20. Accordingly, the players will play the game through the networking system 20 as if they are playing the real table game.

Therefore, the players or users are able to remotely connect the notebook type or tablet type individual electronic device 10 and/or the (AR/VR) device 9 to the remote connecting module 31 for communicatively accessing the communication network 30 and for playing the games or processing the softwares or applications that the communication network 30 provided in an authorized manner. The communication network 30 can be any networks, such as a computer network, International Mobile Telecommunication network, other private internal network, and etc., so that through connecting to the designated communication network 30, the players or users are able to play the games or process the softwares or applications in a remote manner.

The arrangement preferably further comprises the chatting module 43 linked to the networking system 20 for enabling the players or users to chat with each other through the networking system 20 in a real time manner through video, image, audio, and/or text communication via the electronic devices 10 through the networking system 20. The networking system 20 forms not only a playing or processing channel for the players or users to play the game or process the software or application but also a communication channel for the players or users to chat so as to enhance the entertainment of the game or the processing of the software or application, such that the players or users are able to remotely and simultaneously play the same game or process the same software or application and chat with each other via the notebook type or tablet type individual electronic devices 10 and/or in the (AR/VR) devices 9 through the networking system 20.

It is worth mentioning that the player or user is able to search other players through the chatting module 43. For example, the player or user is able to input the player or user name in the electronic device 10 (including for example the AR/VR device 9) for searching a particular player or user. Likewise, the player or user is able to search different players or users within a predetermined radial range of the electronic device 10. The player or user is able to set a private group for one or more designated players or users to join or a public group for any player or user to join.

According to the preferred embodiment of the present invention, the step (b) preferably further comprises a step of providing a virtual dealer to deal and shuffle a predetermined deck of playing cards for the players to play the game through the networking system 20 when the game is a card game.

The method of the present invention may further comprise a step of activating the notebook type or tablet type individual electronic devices 10 and/or the AR/VR devices 9 by the players or users to communicate between the players or users through the communication network 30, so that after the individual electronic device 10 is being activated by the player or user in the authorized manner, the player or user is able to monitor the selected game or the selected software or application on a display screen of the individual electronic device 10 and to controllably interact with the game, such as entering a common or betting for gambling type games, or the softwares or applications.

According to the preferred embodiment of the present invention, the central control 40 further comprises a verification module 44 for verifying the player or user to play the game or to process the software or application via the individual electronic device 10 in the authorized manner, wherein each of the players or users is able to sign in the networking system 20 to participate the games or the softwares or applications and to sign out the networking system 20 to quit the games or the softwares or applications at any time.

According to the preferred embodiment of the present invention, the verification module 44 can use the biometric technology, such as fingerprint, face recognition, hand geometry, iris recognition, or the like, to verify the person whether he or she is the authorized player or user. Preferably, a photo ID is used at the time when the player or user signs in and signs out the game or the software or application while the date and playing or processing time will be recorded.

Therefore, the step (a) may further comprise a step of verifying the player or user to play the game or to process the software or application via the individual electronic device 10 in an authorized manner. Each of the players or users may be able to sign in the networking system 20 to participate the game or the software or application and to sign out the networking system 20 to quit the game or the software or application at any time, so as to activate the individual electronic devices 10 in the authorized manner.

Therefore, the networking system 20 is able to remotely connect two or more real players at the same time for the player competing or playing against other real players or users simultaneously over the communication network 30. It should be noted that, through the networking system 20, the players or users have no need to physically go to a predetermined gathering location, such as in a gaming room, or a gaming table, while still being able to enjoy the fun and realistic of playing games or processing softwares or applications with other real players or users.

Accordingly, the surrogate character can be created by the player or user that the surrogate character will be displayed during the playing or processing time. Therefore, other players or users will see the surrogate character instead of the actual image of the player or user. In addition, the username can also be created by the player or user such that the username will be displayed instead of the actual name of the player or user. Therefore, the player or user will be given a player ID and profiled photo ID during the game or the application. Of course, the player or user must use his or her truth person information to register and sign in the central control 40 in order to play the games or to process the softwares or applications.

A character development module 434 will be provided for the players or users to create their personalized surrogate character, wherein a plurality of fantastic computerized characters will be provided for the players or users to select in order to enhance the entertainment, processing and/or gambling experience. In addition, the character development module 434 further includes digital programs to convert drawings and voice speech into text messages or into digital tool characters.

The central control 40 may further comprises a chatting program of the chatting module 43 stored thereat, so that when two or more players or users are linked to the communication network 30 of the networking system 20 via each of the notebook type or tablet type individual electronic devices 10 and/or the AR/VR devices 9, the players or users are further being able to chat and talk to each other while playing the games or processing the softwares or applications over the communication network 30. Therefore, the reality of the virtual games is further enhanced.

According to the preferred embodiment of the present invention, the step (c) of the method further comprises a step of providing a text communication platform 431 as the chatting module 43 for the players or users to communicate with each other via text message through the individual electronic devices 10, such as notebook, tablet, smart device, and/or AR/VR device, so as to allow the players or users to exchange written messages with each other during playing the games or processing the softwares or applications.

In addition, in order to enhance the reality of chatting with other players or users, the step (c) is preferred to comprise a step of providing a voice communication platform 432 for the players or users to communicate with each other via voice message through the individual electronic devices 10, such as notebook, tablet, smart device, and/or AR/VR device, so as to allow the players or users to talk to each other during playing the games or processing the softwares or applications.

Also, the step (c) is preferred to comprise a step of providing a video communication platform 433 for the players or users to communicate with each other via image messages through the individual electronic devices 10, such as notebook, tablet, smart device and/or AR/VR device, so as to allow the player or users to view each other during playing the games or processing the softwares or applications and to further enhance the reality as of playing the games or processing the softwares or applications face-to-face with other players, users and/or dealers in the real time manner.

Therefore, in order words, the chatting module 43 preferably comprises the text communication platform 431, the voice communication platform 432, and the video communication platform 433 that optimizes the reality of playing games or processing softwares or applications without physically showing up at the predetermined location, so that the player or user has relatively more freedom to play the games or to process the softwares or applications anywhere anytime.

A step of posting a record of competence in the game or the software or application for each of the players or users at the respective individual electronic device 10 is preferably provided. The record contains winning/losing records or working records and tax information of each of the players or users in response to the winning/losing records or working records. For example, the remains or totally amount of the cash or gambling chips of each of the players at the same game may be showed on the display screen of each of the individual electronic devices 10.

Accordingly, for example, in the entertainment industrial, there are plenty of casinos or gambling rooms have the gambling type games provided for the players playing the game for betting against each other or wagering against the dealer. However, during the peak of gambling, all the table type games in the casino may be full of the players or tourists, so that the casino may face the shortage of game tables or the shortage of dealers. Therefore, the players in the casino may leave with no choose but instead going to play the machine type gambling games. However, the machine type gambling games in the casino, such as slot machines or roulette gambling machines, does not have the function to allow the players to gamble against the other real players.

Therefore, for example, the communication network 30 is further embodied as a local or private casino communication network 30 for electrically connecting two or more individual electronic devices 10 of one or more casino's customers, so that the players of the casino customer are able to remotely link to the communication network 30 for playing the games remotely through the individual electronic devices 10. Thus, the players are able to gamble anywhere and anytime that he or she is able to connect to the casino communication network 30. In other words, the players not only have their own privacy to play the game at their own desired locations but also have communication and interaction, sociability among other players. Preferably, the electronic device 10 comprises a GPS unit for identifying the location of the electronic device 10. Once the electronic device 10 is out of the casino area or outside of the range of the private casino communication network 30, the electronic device 10 will be disabled.

It is important to understand that the disablement of the electronic devices 10 is a completely disablement of all the functions of the devices. That means no gaming, no processing, no texting, and no internet is allowed. It is not a partial disablement of a program or set of programs and, furthermore, the disablement will activate a security dormant system that is activated when the electronic device 10 is removed from working perimeter boundaries and or tamper within its working perimeter. It will also interact with the surrounding environment.

In a case of removal of the electronic device 10, the electronic device 10 will stop working the panic system, turn on the GPS coordinates, and be given to law enforcement. In addition, the smart phone on file will be called and also the GPS will be activated to located the player or user that the cell towers can triangulate the smart phone position and the credit card will be charged additional penalty fee.

If the smart phone is in the phone cavity 111, the smart phone will not be released by the portable electronic device 10, even when the corrected password is input. Furthermore, the Internet-Of-Things (IOT) can triangulate the device as to the direction, speed and the location of the electronic device 10. Lastly, the electronic device with IOT technology equipped will interact with other interactive devices, such as switching on light bulbs, turning on radios or like, announcing the location of the damaged or out-of-place electronic device 10 by a dedicated (IOT) speaker near an exit or around the establishment. The same will apply to any tampering of the electronic devices 10 within the facility.

Preferably, no electronic device 10 can be turn off/on. All interactive electronic devices 10 will be on stand-by mode at all times, charging or in used. When any of the electronic devices 10 is outside its charging dock and needs to be charged, the electronic device 10 will send a high pitch sound and the security features discussed above will take place except for charging the credit card. In other words, the only portable electronic devices 10 that are completely off are during repairing or being locked away.

It is worth mentioning that the preferred embodiment of the present invention is not to be confused for a temporary partial authorization of a particular function in an electronic device and or in the functions of the AR/VR devices or program applications for these devices. In other words, the portable electronic devices 10 will be disable completely. The user will not be able to operate any functions and, in addition, the dormant security embodiments mentioned before will be activated as part of the total security system. It is important to mention that the disablement of these electronic devices 10 are not for the management and functions of these electronic devices 10, but for the purpose of stopping and preventing illegal operation and crime activity.

In another example, the establishment can also be embodied as an education establishment, such as a tutorial school or college, and the communication network 30 is further embodied as an educational communication network 30 for electrically connecting two or more individual electronic devices 10 of one or more student users thereof, so that the student users are able to remotely link to the communication network 30 for processing education softwares or applications, such as doing a joint project or homework, remotely through the individual electronic devices 10. Thus, the student users are able to discuss, communicate, and doing work anywhere and anytime that he or she is able to connect to the educational communication network 30. In other words, the student users not only have their own privacy to do the work at their own desired locations but also have communication and interaction, sociability among other group students.

In another example, the establishment can also be embodied as a working establishment, such as a working facility, the communication network 30 is further embodied as a working communication network 30 for electrically connecting two or more individual electronic devices 10 of one or more employed workers thereof, so that the worker users are able to remotely link to the communication network 30 for processing working softwares or applications, such as doing a joint project or program, remotely through the individual electronic devices 10. Thus, the worker users are able to discuss, communicate, and doing work anywhere and anytime even they are not at the seats as long as he or she is able to connect to the working communication network 30. In other words, the worker users not only have their own privacy to do the work at their own desired locations but also have communication and interaction, sociability among other workers or their supervisors. Preferably, each of the electronic devices 10 comprises a GPS unit for identifying the location of the electronic device 10. For example, once the electronic device 10 is located outside the working area or facility or is out of the range of the working communication network 30, the particular electronic device 10 will be disabled for security reasons.

For instance, the players or users may be able to connect the individual electronic devices 10 to the communication network 30 of the establishment while staying in the establishment, such as hotel of the casino, school or working facility.

Accordingly, for example, the game players are able to play the casino games to wager against the virtual dealer of game program 42 installed in the central control 40 via plugging into a communication plug provided in a hotel room to wirely connect to the communication network 30 of the casino or wirelessly link to the communication network 30 of the casino with a provided password. Therefore, the players are able to remotely gamble via playing the virtual games over the communication network 30 against other real players in a real time manner.

Also, the student users are able to do their home works or projects through the designated softwares or applications installed in the central control 40 of the school via plugging into a communication plug provided in their dormitory or library to wirely connect to the communication network 30 of the educational facility or wirelessly link to the communication network 30 of the educational facility with a provided password.

Therefore, the student users are able to remotely and jointly work via the softwares or applications over the communication network 30 with other student users in a real time manner.

Similarly, the worker users are able to do their works or projects through the designated software or application installed in the central control 40 of the working facility via plugging into a communication plug provided in the work station, meeting room, cafeteria, or etc. to wirely connect to the communication network 30 of the working facility or wirelessly link to the communication network 30 of the working facility with a provided password. Therefore, the worker users are able to remotely and jointly work via the softwares or applications over the communication network 30 with other users in a real time manner.

Figure 2:
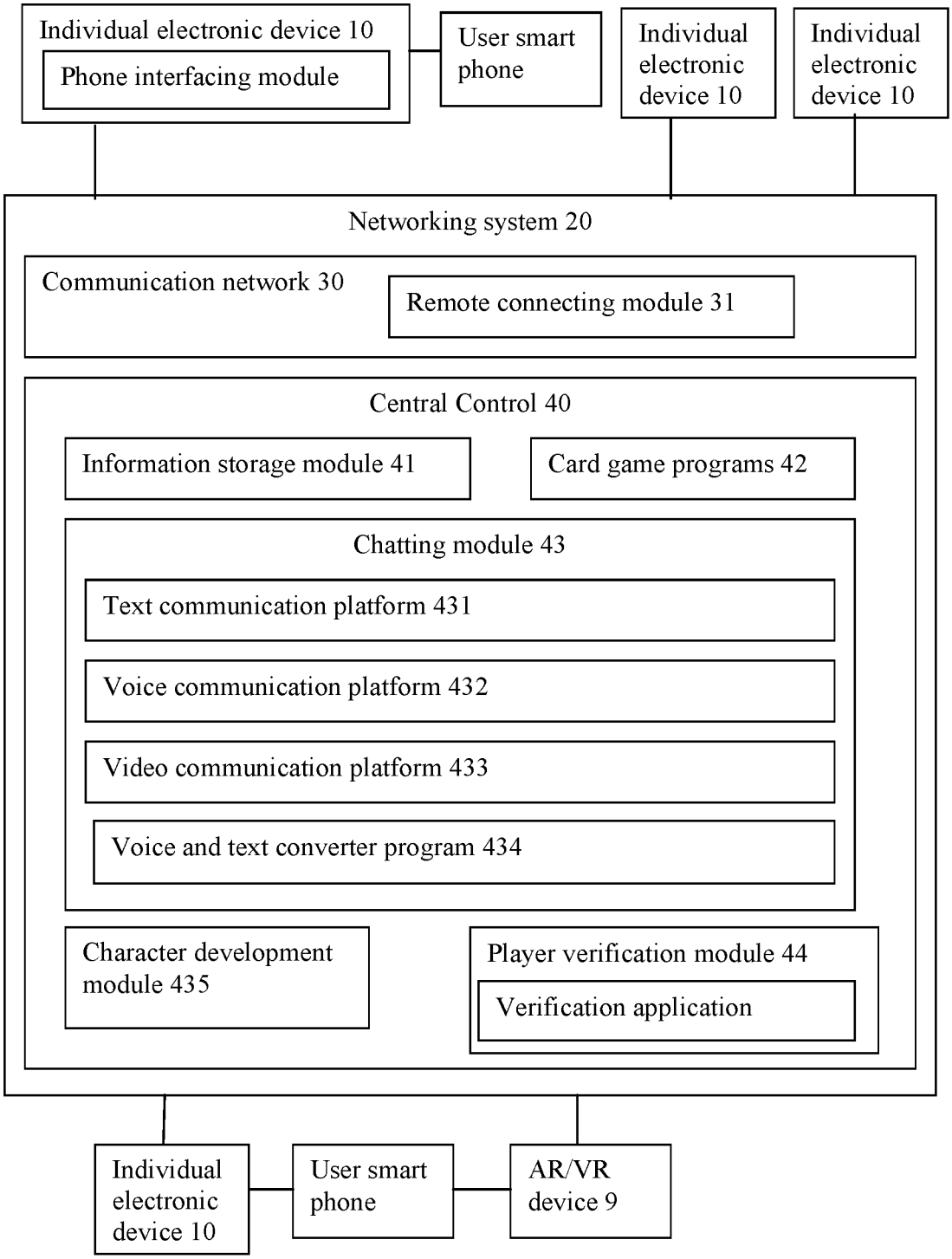
FIG. 2 is a block diagram of an operating system of two or more electronic devices according to the preferred embodiment of the present invention.

Referring to FIG. 2 of the drawings, the present invention further provides an arrangement of operating multi-task interactive electronic devices for playing games or processing softwares or applications through a networking system 20 thereof. The arrangement comprises the networking system 20 which preferably comprises the communication network 30 and the central control 40 as mentioned above, and the plurality of individual electronic devices 10, such as a notebook type electronic device as illustrated in FIG. 3, an augmented reality and virtual reality (AR/VR) device 9 as illustrated in FIGS. 3A and 3B, a tablet type electronic device as illustrated in FIG. 5, an innovative electronic device as illustrated in FIGS. 6A to 6C, and/or any other like electronic device adapted to be operated with a sideline program to form and display a slidable sideline on the display screen and/or the control panel of the electronic device 10.

As an example, when the present invention is embodied as a method of playing games in a casino or the like as the establishment, the individual electronic devices 10, such as a personal computer, a notebook, a tablet, an iPad, a smart phone, a portable personal electronic device, an AR/VR device, or any other electronic devices which is able to link to the networking system 20 wired or wirelessly in the remotely connection manner, wherein the casino players are able to use the individual electronic devices 10 as the portable game consoles to remotely joint the networking system 20 for selectively monitoring and interacting with the games displayed on the game consoles with other real gambling players in the real time manner. In other words, each of the individual electronic devices (game consoles) 10 is programmed to be able to interact with the other paired game consoles 10 for playing the same game in real time manner.

It is worth mentioning that the casino players are able to select variety games provided in one single game console 10, so that there is no need for players physically going to each of the gambling table for different types of games. Also, the players do not have to join the crowded gaming tables of the games while being able to enjoy playing with other players, to socialize with other players, and enjoy the entertaining environment in the casino.

The game console (electronic device) 10 in the casino remotely linked to the networking system 20 to communicate with the central control 40 is also programmed that the game console 10 is able to automatically count the winning or losing of each round of the game, so that the players may be able to collect the credit of winning or losing and cash the credit after the finishing the games. Therefore, the game consoles 10 are able to enhance the safety of the players by eliminating the need of carrying large amount of chips or cash, and solve the problem of the dealer shortage in casino.

In the preferred embodiment of the present invention, the method of operating multi-task interactive electronic devices for playing games may further comprise a step of providing a plurality of the game consoles as the individual electronic devices 10 which can be interacting with each other for playing the same game and/or chatting with each other, so that the players of the casino customers are able to operate multiple tasks with their game consoles 10. For example, the players can enjoy the games simply via the display of their game consoles 10 to bet, monitor the games, and to remotely play with other real players who's being automatically arranged to the same virtual game room of the game via the central control 40. Therefore, the players are able to stay in the same seat for selectively playing the games without moving around to different gaming tables of the games. Accordingly, casino will increase value of clients without having to expand casino facility size or increase extra wages for additional employees. By saving construction cost and waging cost, casino will be able to develop better services and to maintain high level entertainment quality.

As mentioned above, the arrangement may further comprise the chatting module 43 electrically stored in the central control 40, so that the players are able to play against the other players remotely connected to the networking system 20 while talking and chatting with each other, so as to enhance the reality as of playing in a real gaming table of game. In other words, the player, who is the casino resort quest, can play game any time anywhere even he or she is not presently stay in the casino resort.

The information storage module 41 of the central control 40 may store a plurality of personal information of the players, such as the ID numbers, pictures, phone numbers, names, mail and email addresses, passwords, and/or any activity records regarding the playing of the games, such as gaming dates, winning or losing thereof, and any other activities in casino. The information storage module 41 may further digitally store the cash flow information of the players, such that the players are able to directly bet against the virtual dealer of the networking system 20 and to deduct or add the amount of the cash stored in the information storage module 41 in responsive to the winning or losing of the games.

Accordingly, the information storage module 41 will store the surrogate character created by each of the players. In addition, the information storage module 41 will also store the tax information of each of the players. When the player plays each game, the gambling tax will be determined when the player wins the game. In other words, when the player logs out the game, the gambling tax will be determined and recorded in responsive to the gambling winning or losing. The gambling tax will be accumulated for a time period, such as yearly, wherein a gambling tax statement will be printed and sent to each player for tax purpose.

The communication network 30 of the arrangement is preferably embodied as a private casino communication network 30 provided for the players of the casino customers accessibly link with the communication network 30 in the authorized manner for entertaining the customers thereof. The game consoles 10 are electrically and remotely linking to the casino communication network 30 to form the networking system 20 for remotely playing games through the game consoles 10 or any other individual electronic devices 10, such as AR/VR devices 9, in the real time manner.

The individual electronic devices 10 in the preferred embodiment of the arrangement, such as personal computer, notebook, tablet, or AR/VR device loaded with the sideline program as described below, may be able to activate in the hotel room of the casino wirely or wirelessly as mentioned above, so that the players of the casino customers are able to simply relax in their own rooms without physically coming out to the main gambling area of the casino, so as to further provide another way to enjoy gambling and playing games in the casino.

According to the preferred embodiment of the present invention, the players are able to remotely link to the individual electronic devices 10 via the casino communication network 30 through the remote connecting module 31 thereof, wherein the casino may provide a membership card or the like to each of individual players of casino customers, wherein the membership card is preferred to include a magnetic strip or smart chip that stores the corresponding personal information of the customer, so that when the membership card is being inserted into the individual electronic devices 10, the preloaded sideline program in the electronic device is activated and the communication network 30 is linking the individual electronic device 10 to the information storage module 41 of the central control 40 automatically, so that after confirming the players information by matching with the stored information in the information storage module 41 to authorize the activation request from the player, the central control 40 will automatically and remotely activate the computer program and the sideline program in the electronic device 10 to remotely link to the networking system 20. Preferably, the photo ID is required to sign off to the individual electronic device 10 with date and time recorded. Therefore, the individual storage module 41 is able to link to the individual electronic devices 10 for posting the record of the competence in the game for each of the players at the respective individual electronic device 10.

Alternatively, the individual electronic device (game consoles) 10 may be activated by providing the predetermined account, the user name and the corresponding passwords thereof, so that the players are able to enter the user names and passwords to submit to the central control 40 for being authorized to activate the individual electronic devices 10.

Alternatively, the electronic device (game console) 10 can also be activated by inserting a financial card, such as credit card, debit card, or the likes, so that the private casino communication network 30 may direct the players to the central control 40 for accessing the game programs 41 to remotely play the games through the individual electronic devices 10 supported by the sideline program and to automatically deduct all charges from playing the games directly from player's financial card.

Alternatively, the individual electronic device (game console) 10 is provided with input devices, including but not limited to a front/back camera 145 for image capturing and face recognition or, alternatively, a motion sensor 146 for motion detection, an image (holograph/light) projector 143 for non-touch interactive display motion and voice command, a microphone 142 for voice capturing, voice recognition, voice command, and/or a fingerprint scanner for fingerprint recognition, to function as activation tool of the electronic devices 10 as well as the sideline program loaded in the electronic device 10, so that the individual electronic devices 10 and the sideline program can be activated by recognizing the player's face, voice and/or fingerprint which is submitted to the central control 40 for being authorized to activate the individual electronic devices 10 for accessing the game programs 41 to remotely play the games through the individual electronic devices 10, to operate the individual electronic devices 10 with the supporting sideline program, and to automatically deduct all charges from playing the games directly from the player's final card.

It should be noted that the membership card can also integrate with the room card key of the casino hotel, so that the casino can easily charge the fee of the entertainment of playing game through the room payment account of the players. The membership card can have variety of shapes, such as traditional flat rectangular shaped magnetic card or IC card, or chips shaped having magnetic sensor therein for electrically communicating with the individual electronic devices 10, in such a manner that the players are able to conveniently activate the individual electronic devices 10 and saving or transferring a predetermined amount of cash or credit therein without carrying around actual casino gambling chips or cash. It is worth mentioning that the players can also pay or paid through their smart phone application such as "Wallet", "ApplePay", "Alipay", "Bitcoin", or the like. The casino is able to securely manage the authorization of the players to enhance the security of casino. The information of the player, including credit card information and personal information, will be encrypted and stored, such tokenization, for enhancing the data security.

Therefore, the method of operating multi-task interactive electronic devices for playing games may further comprise a step of authorizing the remotely submitted activation requests by the players via each of the individual electronic devices 10. Accordingly, the players are able to securely activate the individual electronic devices 10 for linking with the communication network 30, such as the private casino communication network 30 via the remote connecting module 31, so as to enhance the safety of the players and the casino. The authorizing of the activation requests of the players may be performed via providing the membership cards, or any of the above mentioned methods to accomplish the authority of the players via the individual electronic devices 10.

It is worth mentioning that the electronic device 10, i.e. the portable game console, may be provided in every guest room as standard casino equipment ready to be utilized by the hotel guests of that particular room or requested on demand. For example, the same credit card of the user for the hotel will link to electronic device 10 for security purpose so as to provide the casino guests the correct financial statement. Criminals will be less likely to stay overnight. It is also important to mention GPS is in every electronic device 10. This is why GPS is so important to the collective operation of the present invention. Another safety feature that is link with the GPS is that the electronic device 10 will stop all operations when the electronic device 10 is located outside its predetermine intranet working area. It is also worth mentioning when the electronic device 10 is back in its working territory, the electronic device 10 will not return to operational capacity. The electronic device 10 must be return to the casino for evaluation and maintenance for a complete total restart-up.

As will be readily appreciated by one skilled in the art, the arrangement of playing game preferably further comprises a private casino communication networking platform for remotely linking with the individual electronic devices 10 in the authorized manner and for providing an interface for the player managing their private account information and selectively controlling and monitoring the games through the individual electronic devices 10.

Accordingly, the step (b) of the method of playing games may further comprises a step of providing the private casino communication networking platform for remotely linking the communication network 30 with the individual electronic devices 10 and providing a game interface for the players to interact with games and other registered players of the networking system 20. It is worth to mention that the central control 40 may further electrically link to any other facilities or service system attached to the casino, so that the players of the casino customers are able to link to the interface of the casino communication networking platform for selectively and remotely placing an order, such as ordering room services, or reserve the restaurant reservation.

Accordingly, each of the individual electronic devices 10 further comprises a communication key to instantly communicate to the networking system 20. For example, the communication key can be a service request button arranged in such a manner that when the service request button is pressed, the operator of the central control 40 will be notified to provide high quality service to the player. Therefore, even the player stays at the hotel room or sits in front of the individual electronic device 10 in the casino, the player will get the service immediately. The communication key can also be a panic button arranged in such a manner that the operator of the central control 40 will be notified in case of emergency. For example, when other players are cheating during the game, the player is able to notify the operator immediately. Or when the players are in dangerous, such as someone breaking in his hotel room, the operator of the central control 40 will be notified immediately.

Accordingly, the step (a) of the method may further comprise a step of providing the plurality of game console in the casino as the individual electronic devices 10, so that the casino is able to provide the players of their customers another way to enjoy playing games or gambling as mentioned above.

According to the preferred embodiment, the method of the present invention further comprises a step of providing information of the casino including the services and upcoming events such as game competition, room and restaurant reservation, casino schedule, promotion, and etc.

The present invention enables multiple ways of communication in the arrangement, which includes texting, chatting, audio, video, photos, and the like in combination or selective modes without interfering in the flow of the game, among all guests and service personnel of the facility, such as the casino and the hotel or those who mutual accepted to form a communication group. There is an external component for surrounding people not playing with the users and there is an internal component for players playing with the users in the device.

In the external component, there are 1) general and surrounding personal surrogate greeting, 2) personal profile, 3) filter profile system, 4) save match, 5) line of sight, 6) save profile 7) on and off system of communication of any or all external components. It is important to note that, in the external component, you can only save match and save profile information of other surrounding players, and only in the internal component, the user can communicate live. In save match mode, the computer will tell you when that particular person is able to play with you and in save match mode the user can put a numerical priority pending the other player availability. It is important to note the general personal profile can be of the same nature with the personal profile or they can be totally different. In the save profile, the line of sight and general profiles will be save. To be review now or later with the save profile, one must ask permission to the general profile or the line of sight profile to play together (which is different from save match). And the pictures/photos can be real or of a fantasy in nature.

In the internal components, user will select from novice mode, knowledgeable mode, skillful mode, and expert mode. These modes select the time function for all texting, chatting, pictures, videos, and audio during game time. It is important to note the user can have his or her picture displayed or the surrogate picture in the game to represent his or he physical table location in the game. It is important to note during the game only the players will see each other's selection of communication and all the pictures of the other players in the table. Some may want only using audio while other may only want pictures and text to communicate. And, it is in this window where each other past statistical analysis because this game will be recorded and updated no matter what mode the user in, for future reference.

It is important to note when playing in the skillful mode or expert mode, players can designate the table limits over, for example, 100 dollars and when two or more players want to share each other's general profile or personal profile and still play, they must request each other's approval to change game to novice mode or knowledgeable mode this will aloud for better flow of the game.

The electronic device 10 of the present invention will only save players that have both accepted to be saved and, in the future, if any of those players is in the same casino, it will automatically inform the user and the save match will let the user prioritize any preference of payers.

According to the preferred embodiment, the arrangement of the present invention can be set or modified to be used and customized for a facility or establishment, such as casino, resort, hotel, business entity, amusement park, university, resort, convention center, cruise, and the like. To a casino, the game will be the gambling game, such as card game. To a business entity, the method and arrangement of the present invention can be used for playing training games or processing softwares or applications for works or projects. To an education establishment such as university, the method and arrangement of the present invention can be used for playing educational games or processing softwares or applications for homeworks, teaching projects, league projects, and etc. To an amusement park, the method and arrangement of the present invention can be used for playing introduction games or processing softwares or applications for tourist guide or conducting sightseeing tour. Person skilled in the art will find easily applying the method and arrangement with the electronic devices disclosed in the present invention to play games or process softwares and applications within a facility or establishment for specific purpose.

The electronic device 10 is preferred to be a portable electronic device, such as notebook, tablet, console, smart phone, PDA, AR/VR device, and the like, provided by the facility or establishment for the users to individually access respectively, wherein each of the electronic devices 10 comprises a plurality of different applications preloaded therein, a positioning unit such as a GPS unit and a phone connection station 11 for connecting with an identification means. According to the preferred embodiment of the present invention, the identification means is embodied as a user smart phone of the user. It is appreciated that the identification means can be any other means as described above, including but not limited to ID card, smart chip, memory card, flash drive memory, face recognition means, voice recognition means, fingerprint recognition means, and etc.

The present invention further provides a method of communicatively linking the electronic devices 10, which is executed by a computing system, such as electronic computer, quantum computer, liquid computer, server, IOT (internet of things), blockchains, and etc.

It is worth mentioning that blockchains are secure by design and are an example of a distributed computing system with high Byzantine fault tolerance, wherein decentralized consensus has therefore been achieved with a blockchain. This makes blockchains potentially suitable for the recording of events, medical records, video and/or casino games, and other records management activities, such as identity management, documenting provenance, food traceability or voting. In other words, a blockchain is a continuously growing list of records, called blocks, which are linked and secured using cryptography, wherein each block typically contains a cryptographic hash of the previous block, a timestamp and transaction data.

The method of communicatively linking the electronic devices 10 comprises the following steps:

(1) Remotely link the electronic devices 10 in a closed communication network 30, wherein the electronic devices 10 and the closed communication network 30 are provided by the facility.

(2) Verify each user for the respective electronic device 10 in an authorized manner in order to activate the electronic device 10 by connecting a user smart phone of the user to the electronic device 10.

(3) Restrict each user to remotely access the electronic device 10 in limited locations within an area of the facility via the GPS unit, the cell tower and/or the internet of things (TOT) technology built-in with the electronic device 10 and within a range of the closed communication network 30.

(4) Connect the electronic devices 10 with each other through the closed networking system 20 that allows the user to selectively communicate with each other and to selectively execute different applications preloaded in the electronic device 10 through the closed networking system 20 in a real time manner.

According to the preferred embodiment, the electronic device 10 is arranged for connecting to the user smart phone. The electronic device 10 can be connected to the user smart phone wirelessly or by wire. Accordingly, through the connection between the electronic device 10 and the user smart phone, the record of the competence is sent to the user smart phone when it is authorized by the user. According to the preferred embodiment of the present invention, the electronic device 10 is wirelessly connected to the user smart phone by means of "Bluetooth", "NFC", "WiFi", LTE, 4G, ECT, or the closed communication network. It is worth mentioning that when the electronic device 10 is connected to the user smart phone by wire, the user smart phone is also charged by the electronic device 10, so as to prevent the user smart phone out of battery. Alternatively, the electronic device 10 may also provide with a charging pad for electrical charging the user smart phone. For wireless connection, the phone connection station 11 can be a wireless connection module having a predetermined connection range, such as 10 feet, of the electronic device 10, wherein the user smart phone should be located within the connection range of the electronic device 10. When the user smart phone is out of the connection range, the electronic device 10 will disconnect with the user smart phone.

As shown in FIG. 3, the phone connection station 11 is arranged for holding the user smart phone in position. The phone connection station 11 can be a storage cavity 111 that the user smart phone can be received therein. Once the user smart phone is stored in the storage cavity 111, the electronic device 10 can be connected to the user smart phone wirelessly or by wire. In one embodiment, the user smart phone is received in the storage cavity 111 of the phone connection station 11 and is connected to the electronic device 10 via a connection cable 114 extended from the storage cavity 111. Therefore, the user smart phone is charged by the electronic device 10. In other words, the connection cable 114 is connected directly to the user smart phone or a charging pad for electrical charging the user smart phone and for activating the electronic device 10 as well as its supporting sideline program. The electronic device 10 may or may not disconnected and deactivated when the connection cable 114 is disconnected to the user smart phone. In the secure holding, the electronic device 10 will activate an alarm system that will not release the storage cavity lock to the smart phone without a correct password. In other words, the user must enter a correct password, such as preset by the user, in order to release the storage cavity smart phone from the electronic device 10 once the user smart phone is inserted at the storage cavity 111. It is also important as part of the security system if any of the electric devices 10 is moved out of the facility, the electronic device 10 will also not release the smart phone in the storage cavity 111 even though the correct password is entered, and furthermore the dormant security system will be activated.

Accordingly, each of the electronic device 10 further comprises a phone interfacing module for screen-imaging the user smart phone on the electronic device 10. When the electronic device 10 can be connected to the user smart phone, the display screen of the electronic device 10 will interface with the user smart phone. For example, the display screen 12 of the electronic device 10 will be synchronized to image the screen of the user smart phone, such that the information displayed on the screen of the user smart phone will be displayed on the display screen 12 of the electronic device 10. Even though the user smart phone is received in the storage cavity 111 of the phone connection station 11, the user is able to view the information to be displayed on the user smart phone through the display screen 12 of the electronic device 10 or by opening a new window on the display screen 12 of the electronic device 10 to display the synchronized image of the screen of the user smart phone without removing the user smart phone from the electronic device 10. It is worth mentioning that the electronic device 10 cannot obtain or share any personal data from the user smart phone, such that no phone data will be transferred or stored in the electronic device 10 when it is connected to the electronic device.

It is worth mentioning that the phone connection station 113 is for the user smart phone and is held at the docking station 112, wherein a terminal plug 113 is provided at the docking station 112, such that when the user smart phone is docked at the docking station 112, the terminal plug 113 is inserted into a terminal slot of the user smart phone to connect to the user smart phone to connect with the electronic device 10 for data transmission. Therefore, the user smart phone can be charged by the electronic device 10. In other words, the terminal plug 113 is connected to the user smart phone for charging the user smart phone and for activation of the sideline program. The electronic device 10 is disconnected and deactivated when the terminal 113 is disconnected to the user smart phone. According to the preferred embodiment of the present invention, the electronic device is embodied to be activated and to activate the sideline program by an identification card, such as a membership card, issued by the facility by inserting the identification card into a card reader slot 102 of the electronic device 10.

In one embodiment, the closed communication network 30 is a private casino communication network provided by the casino, such that the electronic devices 10 are connected with each other through the private casino communication network 30. The identification card can also be the casino room card, such that the electronic device 10 and the sideline program in the electronic device 10 are activated by the casino room card. In addition, the electronic device 10 and its sideline program can also be activated by the user smart phone. The verification module 44 further comprises a verification application arranged for being downloaded to the user smart phone, such that when the verification application is executed by the user smart phone, the electronic device 10 and its sideline program are automatically activated. The user is able to input the user' name and hotel room number, as an example, after the verification application is executed by the user smart phone. Then, the verification module 44 will verify the user when the user smart phone is linked to the networking system 20 through the mobile communication network or private casino network. For example, the verification application will generate a verification code at the user smart phone, such that when the verification code is sent to the verification module 44 by the electronic device 10 through the private casino communication network for verification, the electronic device 10 will be automatically activated. Likewise, the user is able to input the verification code in the electronic device 10 for activation. It is worth mentioning that since the electronic device 10 is connected to the user smart phone, the verification code can be directly sent by the electronic device 10 to the verification module 44 through the private casino communication network for activation. Once the user smart phone is disconnected from the electronic device 10, the electronic device 10 will be automatically deactivated and locked. Therefore, the player requires re-activation of the electronic device 10 by the room card, player card and/or the user smart phone, wherein it is worth mentioning that the smart phone application can have all the biometric security features like iris, facial geometry, hand-voice recognition, facial pictures, finger print, and etc.

The electronic device 10 further comprises a connection indicator 13 generating a connection signal for indicating a connection between the electronic device 10 and the user smart phone. In one embodiment, the connection indicator 13 comprises a light indicator 103, which comprises at least a LED light, and/or an audio indicator 104, which comprises at least a speaker 144, provided on the electronic device 10, wherein the light indicator 103 is on for generating a light signal, such as a green light, and/or the audio indicator generates an "On" sound signal, such as a beep sound through the audio indicator 104, when there is the connection between the electronic device 10 and the user smart phone. Therefore, the player is notified that the user smart phone is received in the storage cavity 111 of the phone connection station 11. In other words, the connection indicator 13 will generate the notifying signal that also indicates the presence of the user smart phone in the phone connection station 11.

It is worth mentioning that the audio indicator 104 of the electronic device 10 can be activated for additional notification and voice command from the facility, playing music, voice communication with the employees of the facility, other users, or sound information during the playing of the games or processing of the softwares or applications.

When the electronic device 10 is disconnected from the user smart phone, the light indicator will be off and the audio indicator will generate an "Off" sound signal, such as two beep sounds. In other words, once the user smart phone is removed in the storage cavity 111 of the phone connection station 11 by unplugging the connection cable, the light indicator will be off and the audio indicator will generate the "Off" sound signal.

Softwares and/or applications of games, functions and different amenities are preloaded in the electronic device 10, wherein the users are able to acquire different games, functions and services provided by the facility via the applications of amenities. In one example, the amusement park will provide the electronic device 10 with different applications of amenities for different entertainment attractions, rides, and other events. The user is able to selectively execute the designated application of amenities to reserve a timed ticket for the rides, such that the user is able to spend time elsewhere instead of waiting in line for the rides and events. The user is able to selectively execute the designated application of amenities to make a table reservation of a restaurant in the amusement park and even able to view the menu and to pre-order food from the restaurant in advance. Through the GPS unit, the user is able to view the map in the amusement park and the user location there within to guide the user to go from place to place. The parent user is able to track the location of child in the facility via the GPS unit. In addition, different game applications preloaded in the electronic device 10 enable the user to play the games with the electronic device 10, especially during the waiting time or spare time. Parental controls can be set in the electronic device 10 by the parent users that sets controls for the use of the electronic device 10 by their children.

When equipments, furnitures, instruments, or other things provided in the facility are functioned with the technology of IOT (Internet-Of-Things), the electronic devices 10 can be preloaded with applications for interacting with and/or controlling such things.

In one embodiment, the casino provides the electronic devices 10 for the players or users, wherein the applications are different game applications and different applications of amenities preloaded in the electronic devices 10. Each of the game applications is executed in the electronic devices 10 for the users playing casino games with each other or against a virtual dealer through the private casino communication network in a real time manner. Each of the applications of amenities is executed in the electronic device 10 for the users acquiring different services provided by the casino. For example, the user is able to selectively execute the applications of amenities to make a table reservation of a restaurant in the casino. The user is able to set the room configuration in advance, such as switching on the air conditioning system or selectively adjusting the light intensity of the room light before the user enters into the hotel room. It is worth mentioning that since the applications are preloaded in the electronic device 10 and cannot be deleted in the electronic device 10 by the user, the user cannot download these applications into the user smart phone. When the user checks out the hotel casino, the corresponding electronic device 10 will be returned back to the hotel casino. The user verification information will be erased in the electronic device 10, such as deactivated by the user smart phone and/or factory reset by the casino, the user will no longer able to control the room configuration or play the casino game by the user smart phone.

The software operation system and firmware of the electronic device 10 automatically updated by the facility. In one embodiment, the casino will update the hardware and software of the electronic devices 10. For example, the casino will update the game applications and the applications of amenities in the electronic devices 10, such that any new game or new amenities will be updated for the users.

The game application can be configured by the user to set the game expense through an option setting of "playing budget". For example, the user is able set $1000 as the limitation option for playing the casino games through the electronic device 10. When the user loses close the limitation, the electronic device 10 will notify the user, such as through the light indicator and/or audio indicator. It is an option for the user to stop playing the game when exceeding the limitation unless the limitation option is disabled by the user.

It is worth mentioning that the user may charge a predetermined amount of money to the electronic device 10 logged in by the user to pay the accommodation expense, game expense and other service expenses through the user smart phone, Bitcoin application, or other payment applications in the user smart phone.

As shown in FIG. 3, the electronic device 10 further comprises a graphical display 14 for the user to play games. The graphical display 14 comprises a LED or LCD display panel 141 foldably coupled on the electronic device 10 and the holograph/light projector 142 provided on the electronic device 10 for a holograph or a light projection. Alternatively, the display panel 141 can also be embodied as a projector screen and the graphical display 14 further comprises an image projector 143 for projecting an image on the display panel 141. Preferably, the image projector 143 is a 3D hologram/light projector for holograph generation on the display panel 141.

It is worth mentioning that the display screen 12 of the electronic device 10 is a touch screen that the user is able to play any game on the display screen 12. Therefore, the electronic device 10 will provide a holographic display when the user plays the game and/or chat with other users through the electronic device 10. It is an option that the game would be projected on the display panel 141 in a 3D holographic manner so as to enhance the excitement of the game. For example, when playing a card game, the cards can be digitally displayed on both of the display screen 12 and the display panel 141. For privacy purpose, the user is able to select the cards to be displayed on the display screen 12 only. Other displays, such as text messages, game result, and/or other users' surrogate characters, can be displayed on the display panel 141. For example, when the user wins the card game, a message of "win" will be displayed on the display panel 141. It is worth mentioning that the message displayed on the display panel 141 is the holography.

It is worth mentioning that the graphical display 14 of the electronic device 10 can also use another tough screen type display screen to substitute and provide images of the games or applications or function as control console of the electronic device 10. In addition, holograph can be displayed by the image projector (holograph/light) projector 143 on its own without the user of a back surface, wherein the light projection style depends on the display panel 141. Both types can be set to interact with the user for the control of the game, prograph or device through voice command or motion detection through the microphone 142 or the motion sensor 146 respectively and vice versa. The hologram or light projection by the image (holograph/light) projector 143 can be used for alerts and interacting too. For example, the incoming caller can be displayed on the display screen 141 and the callers callsign can be a picture, surrogate, avitar, and/or emoji that can be a light projection or a holograph projection and vice versa.

In one embodiment, referring to FIG. 3A, an augmented reality and virtual reality (AR/VR) device 9 is used as the electronic device 10 of the present invention, wherein the electronic device 10, including both display screen 12 and the control panel 141 as shown in FIG. 3, is a simulated image projected from the AR/VR device 9. The AR/VR device 9 comprises at least a headset 911 for wearing on the head of the user with speakers 912 for the user's surround sound hearing, at least a microphone 913 for receiving voice command, audio reception, voice recognition, and etc. of the user, an augmented reality device 914 for augmenting image projection, a removal virtual reality device 915 for providing virtual reality image projection, and a motion sensing device or camera 916 for detecting motions of the users so that the user may simply operate the display screen 12 as control panel and the user's motions are detected by the motion sensing device or camera 916.

In one embodiment, referring to FIG. 3B, the AR/VR device 9 is interacting with a gaming electronic device 10 and the player or user. The player can operate the display screen 12 and the display panel 141 of the gaming electronic device 10 while interacting with the sideline program to control the game in the AR/VR device 9. The AR/VR device 9 provides augmented reality and virtual reality supporting the game electronic device 10 and motion detection and reception of voice command for operation of the game electronic device 10. The AR/VR device 9 supported with the sideline program also projects sidelines on the display screen 12 and/or the display panel 141 the same as in the physical gaming electronic device 10, wherein the user is able to command through the use of hands, fingers, pupils, head motion, voice command, and etc. The gaming electronic device, the AR/VR device 9 supported with the sideline program, and the smart device such as cellular phone are interacting with each other according to the method and arrangement of operating multi-task interactive electronic devices of the present invention.

In one embodiment, the AR/VR device 9 is activated with the same security requirements for the sideline program by the combination of the smart phone and the security system that maintains the same disable function for the security tampering system as mentioned above in accordance with the invention.

In one embodiment, the game program can be seen in the AR/RV eye/head set of the AR/VR device 9 and the functions of the game are controlled in the gaming electronic device by the sideline program or vice versa. The player can have multiple sidelines operating in the gaming electronic device 10 as well as in the AR/VR device 9 and vice versa. The sideline program for the gaming electronic device 10 and the AV/VR device 9 can both be controlled by voice command. In addition, the motion sensing camera 145 provided on the front/back side of the display panel 141 and/or the AR/VR occipital sensor motion camera 916 can provide the user a 360 degree surrounding motion view of his/her location in the augmented reality and/or virtual reality while the devices 9, 10 are in used.

Also, the gaming electronic device 10 can provide the users of the AV/VR devices 9 a surround sound and the ability for the touch screen display to be an additional interactive tool. The user is able to select what he or she wants on the display screen 12 and what he or she wants on the augmented reality and/or virtual reality to include alert, message, game, confreres, amenities, and etc.

In addition, the AR/VR device can further provide a panic button 901 just like the gaming electronic device 10. In one embodiment, the AV/RV device 9 can be activated by the smart phone and/or the gaming electronic device 10 and vice versa.

In one embodiment, once after the AV/RV device 9 is activated, the AR/VR device 9 can active all other sideline programs in all other gaming electronic devices 10 without additional step in the sideline program security or may only operate in a one AR/VR device 9 to one gaming electronic device 10. The AR/VR device 9 may or may not continue to need the smart phone application authorization. The AR/VR device 9 interacting with the hologram and light projection motion controls can provide the user the best entertainment of his/her life. For example, in the AR/VR device 9, the user can have the holograph/light projection in the gaming electronic device 10 that provides an additional magical ambience as the user is playing on the gaming electronic device 10 in the support of the augmented reality and with the portable gaming electronic device 10 or vice versa.

In another embodiment, as the panic button 901 is armed on the AR/VR device 9, the hologram and/or the light projection and the gaming electronic device 9 are activated to better assist and to identify the location of the user to first responders. It is important to mention that the AR/VR device 9 is one set with multiple functions that the user can detach the virtual reality monitor from the head set allowing the augmented reality controls to activate in addition. The augmented reality visual functions can be turn off allowing the voice command microphone, panic button and the hearing speaker to continue interacting with the electronic device programs.

It is worth mentioning that, through the chatting module 43, the users are able to chat with each other as a group or individually via the electronic devices 10 and/or the AR/VR device 9 through the closed communication network 30. Also, the user may select his or her status as available or not, such that the user is able accept or reject any chatting request from other users.

As it is mentioned above, the information storage module 41, which is executed by the computer of the facility, embodied as casino, linked to the electronic devices 10 for posting a record of competence in the game for each of the users at the respective electronic device 10 and/or the AR/VR device 9 and for transferring the record of competence to the user smart phone. For example, the record contains winning/losing records and tax information of each of the users in response to the winning/losing records.

Each of the electronic devices 10 is preferred to have the panic button 101 for being activated by the user to notify the facility in case of emergency. It is worth mentioning that the facility can have authorization to open the closed communication network to release the restriction of the access of the electronic devices 10, such that the users are able to access the electronic devices 10 through any public communication network. In one embodiment, for example, when the facility is the university, it will allow the students to access the electronic devices 10 through the public communication to access the library, bookstore, and/or classroom information in the university. In addition, the electronic devices 10 can be sold or rent by the facility to the users.

It is worth mentioning that the electronic device 10 of the present invention not only serves as a portable game console or processor for the user to play game or to process software or application but also serves as a conference tablet for conference meeting in the facility. Accordingly, the information and/or keynote of the conference meeting will be automatically saved in the electronic device 10. For example, the conference note will be downloaded in the electronic device 10. The recorded sound and video will be downloaded in the electronic device 10. The text messages, voice messages, video messages, and/or other interacting messages for people will be saved in the electronic device 10. It is worth mentioning that the above information of the conference meeting can also be stored in the "Cloud" storage, such that after the electronic device 10 is returned back to the facility, the user is able to recall all the information by login in the "Cloud" storage.

Figure 4A:
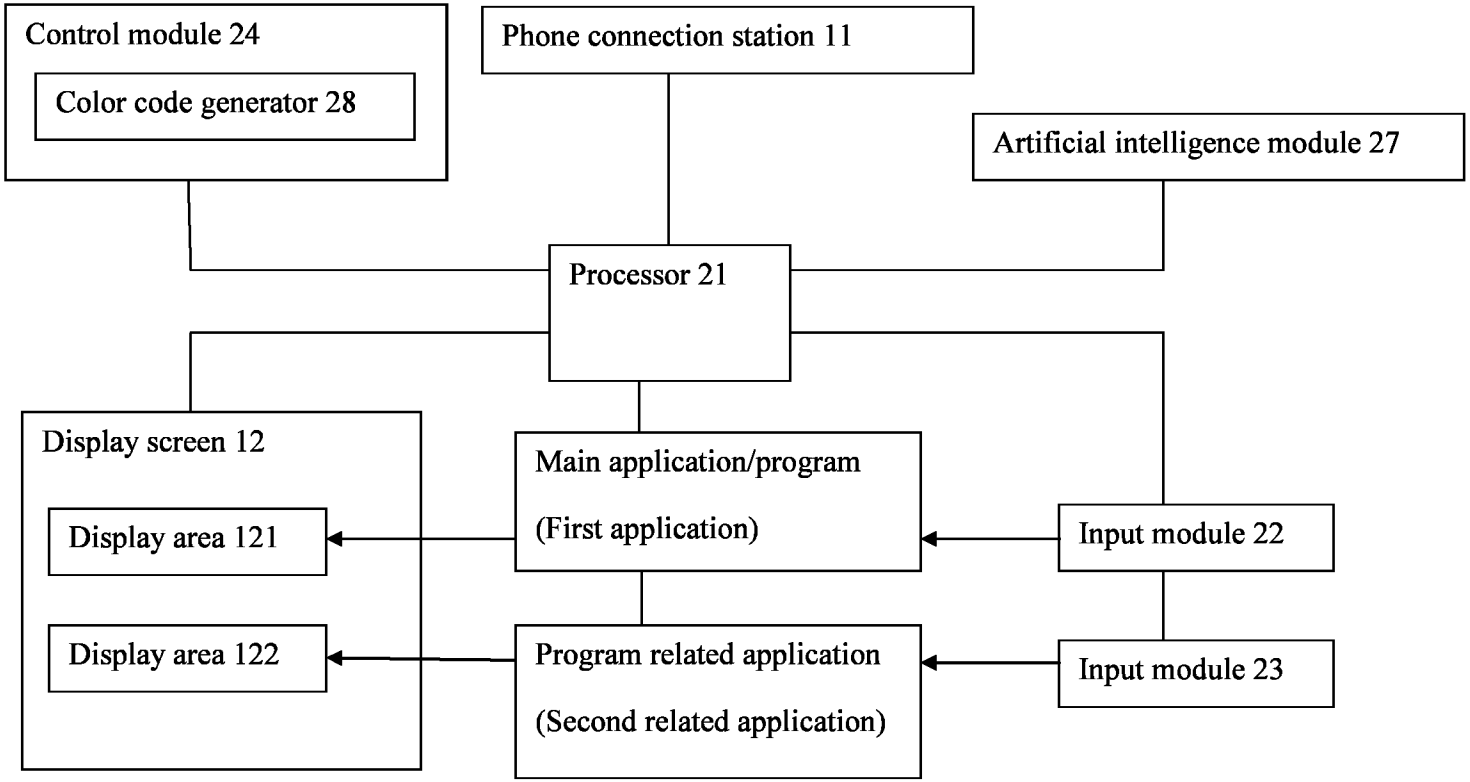
FIG. 4A is a block diagram illustrating a modification of the electronic device according to the preferred embodiment of the present invention.

FIG. 4A illustrates a modification of the electronic device 10 according to the preferred embodiment of the present invention, which is a device for a single touch screen or for multiple touch screen apparatus that is interactive and artificial intelligent that communicates with the operator simultaneously or independent of the games or events being run and without interfering in whatever games or events the operator selects. The electronic device further comprises one or more processors 21, one or more screen modules operatively linked to the processors 21, and two or more input modules 22, 23 operatively linked to the processors 21. Accordingly, the one or more processors 21 are configured to execute two or more applications at the same time.

Figure 3C:
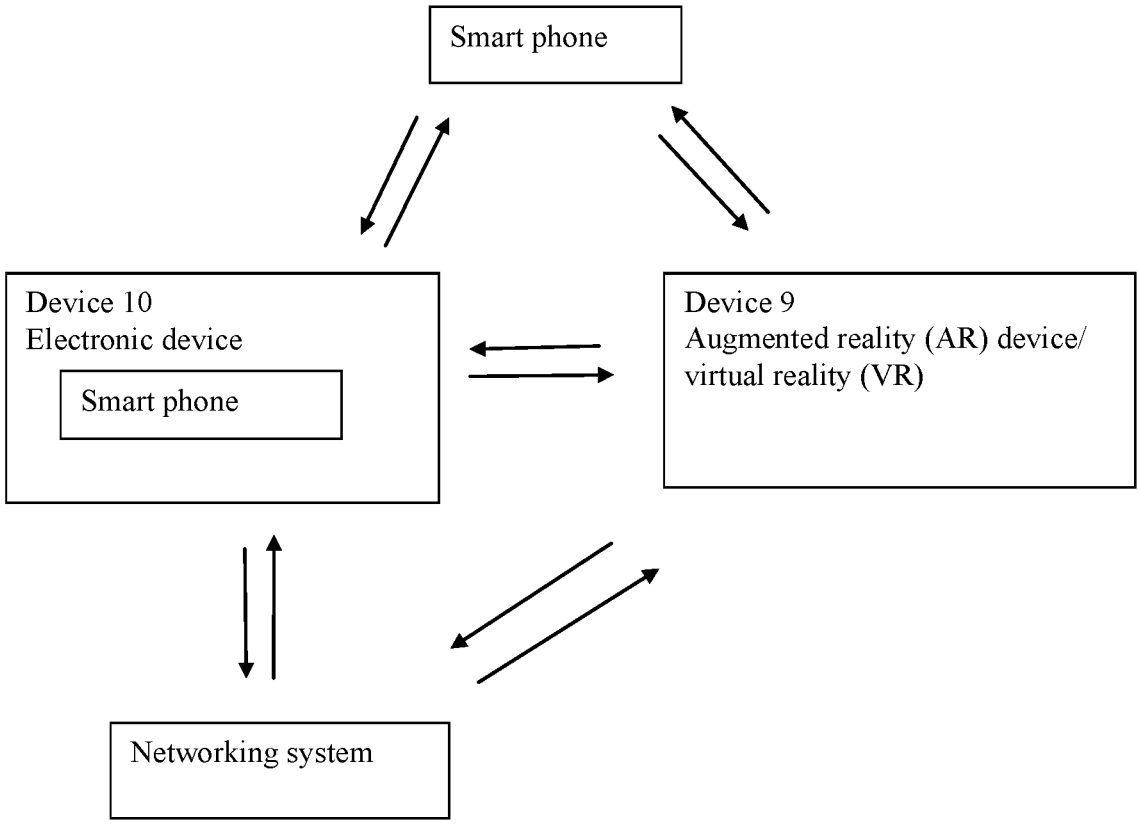
FIG. 3C is a block diagram illustrating the interacting of the electronic device, the AR/VR device, the smart device, and the networking system according to the preferred embodiment of the present invention.

Before further disclosure of the modifications of the electronic device 10 as shown in FIG. 4A to FIG. 10, it is appreciated that the electronic device 10 as illustrated in FIGS. 4A to 10 can substitute the gaming electronic device 10 as shown in FIGS. 3A to 3C to equip and interact with the AR/VR device 9. In addition, the controlling and operating of the sidelines 25 of the sideline program as described below can also be applied and operated in the electronic device 10 as illustrated in FIGS. 1 to 3C according to the preferred embodiment of the present invention. It is worth mentioning that the sideline(s) 25 as a tool for the process of this invention in the electronic device 10 in regard to the sideline program embodied in the AR/VR device 9. In other words, what the user will observe in the AR/VR device 9 in accordance with the invention of the sidelines 25 of the sideline program, with the electronic device 10 or without the electronic device 10. In addition, the sidelines 25 supported by the sideline program will have the same functions as in the electronic device 10, in the smart phone application and in the AR/VR device 9.

Referring to FIGS. 4A to 6C, each of the one or more screen modules has two or more display areas 121, 122, dividing by one or more sidelines 25, for displaying two or more of the applications thereon respectively. Accordingly, the electronic device 10 comprises one or more display screens 12. When two or more display screens 12 are used, two or more of the display areas 121, 122 are formed at each of the display screens 12. When only one display screen 12 is used, at least two of the display areas 121, 122, dividing by one or more sidelines 25, are shared and formed at the single display screen 12. The applications are simultaneously controlled by the input modules 22, 23 respectively, such that the applications are executed to be displayed on the display areas 121, 122 respectively and are independently controlled by the input modules 22, 23 at the same time. It is appreciated that the applications are interactively correlated with each other and are configured in one program, such that when the program is run by one of the processors 21, the applications are simultaneously executed to be displayed on the display areas 121, 121 in one of the display screens 12 respectively. In other words, when the user opens the program, the applications are simultaneously displayed on the display areas 121, 122 of the display screen 12 of the screen module. Accordingly, the input modules 22, 23 can be a keyboard, a touch pad, a set of buttons, a voice control input, a joy stick, a control console, a 3D camera module, a motion detecting input device, and etc.

According to the preferred embodiment of the present invention, the electronic device 10 of the present invention further comprises a control module 24 supported by the sideline program that generates at least one sideline 25 to be displayed on the display screen 12 to split or divide the display screen into two of the display areas 121, 122 on each sides of the sideline 25. It is appreciated that the sideline 25 is a tool that the user can operate to interact and command the functions of the electronic device 10 (and/or the AR/VR device 9). In other words, the sideline program with the sideline(s) 25 generated is the control system to the programs operating in the electronic device 10 (and/or the AR/VR device 9)

Referring to FIG. 5 of the drawings, a single quadrilateral display screen 12 is embodied that, the sideline 25 is a visual line displayed on the display screen 12 to split the display screen 12 into two different display areas 121, 122. The sideline 25 can be, generally, a horizontal sideline or a vertical sideline to split the display screen into side-by-side display areas 121, 122 or upper-and-lower display areas 121, 122. In particular, the sideline 25 is configured to be movable on the display screen 12 to adjust a size of each of the display areas 121, 122 correspondingly.

It is worth mentioning that when two or more display screens 12 are used, each of the display screens 12 is provided with the one or more sideline 25. In this example one to split that display screen 12 into two display areas 121, 122, such that totally four display areas 121, 122 are provided at two display screens 12. Or, alternatively, if only one of the two display screens is provided with the sideline 25 to split that display screen 12 into two display area 121, 122 while the other display screen 12 remains to have one whole display area thereon, so that a total of three display areas will be provided at two display screens 12, as shown in FIG. 6C.

In addition, two or more sidelines 25 can also be formed on one display screen 12 to split the display screen 12 into three or more display areas 121, 122. In other words, two or more margins can be formed on the single display screen 12 to split the display screen 12 into three or more display areas 121 in side by side and/or upper and lower manner. It is important to note that, as shown in FIGS. 5 and 6A-6D, the two display areas 121, 122 separated by the sideline 25 on one display screen 12 are configured to display the games on one of the display areas 121, 122, such as the display area 121, and the programs on the other display area 122 correspondingly. The sideline 25 separates the game programs from other non-game programs.

Figure 4B:
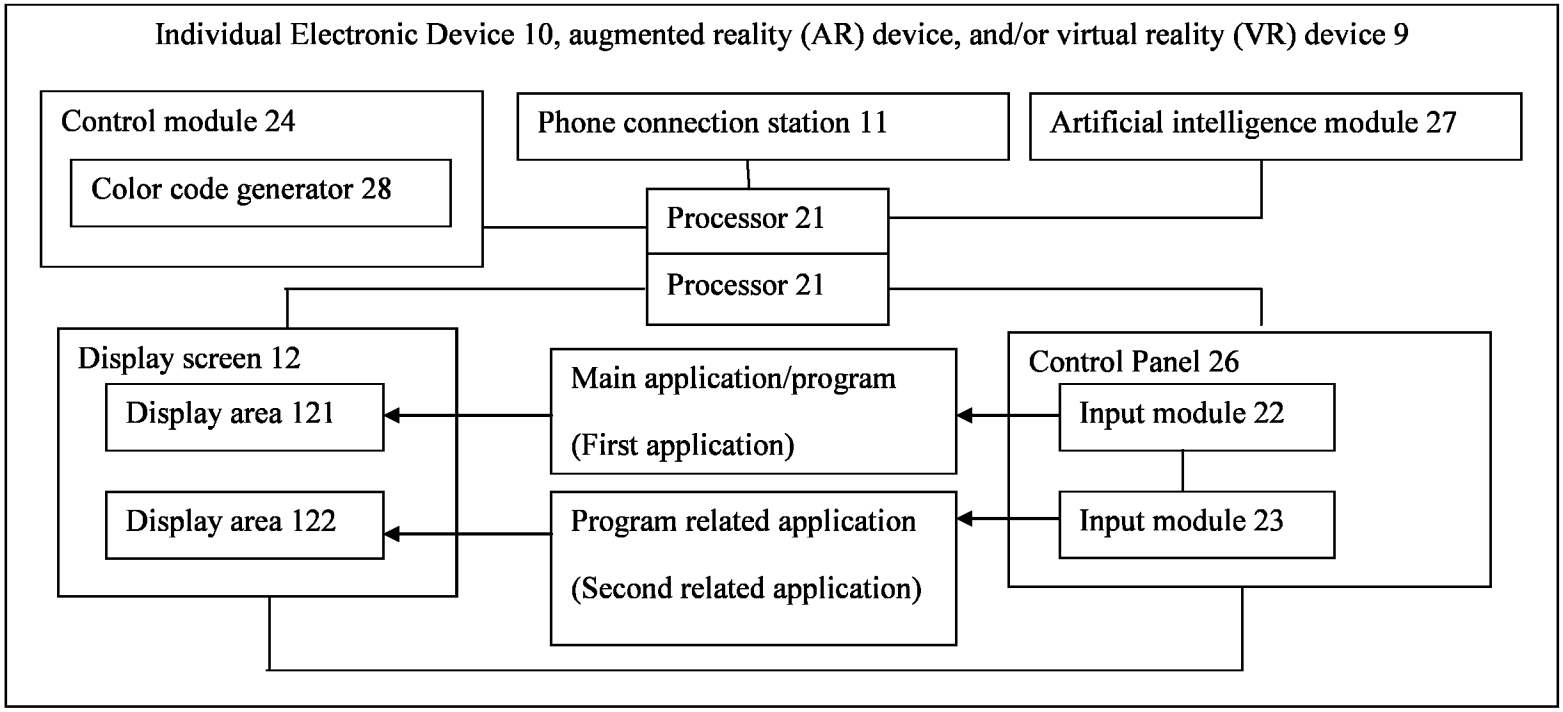
FIG. 4B is a block diagram illustrating another modification of the electronic device according to the preferred embodiment of the present invention.
Figure 4B:
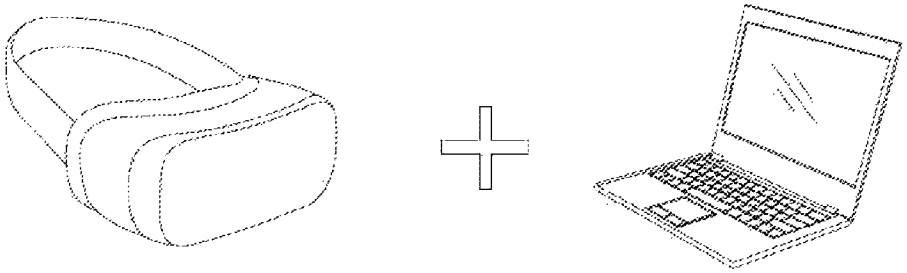

According to the preferred embodiment of the present invention, as shown in FIGS. 4A and 4B, the control module 24 further comprises a color code generator 28 that generates different color codes for the sideline 25 on the display screen 12 to indicate different program or game selections, i.e. different interactive programs, of the application. For example, the first color code generator 28 will generate the sideline in red color for the first interactive program and in blue for the second interactive program. Therefore, the user can notify which interactive program he or she has been selected via the color code of the sideline 25. It is worth mentioning that the color codes can be set by the user via a setting configuration of the control module 24.

In one embodiment, the electronic device 10 of the present invention is configured as a tablet computerized device to have a single display screen 12, such as a touch screen, as shown in FIG. 5. Accordingly, the sideline 25 is a vertical sideline displayed on the touch screen 12 to split the touch screen 12 into two display areas 121, 122. Two different applications are executed and displayed on the display areas 121, 122. At the same time, two input modules 22, 23 are displayed and integrally formed with the touch screen at the display areas 121, 122. The two input modules 22, 23 can be the same or different depending the control of the application. For example, when the application is a game application, the input module 22 can be configured as a touch pad displayed and formed on the display area 121 of the touch screen. When the application is a chatting application, the input module 23 can be a keyboard displayed and formed on another display area 122 of the touch screen. The user can simply maintain a finger touching on the sideline 25 and move leftwards or rightwards, the sideline 25 is able to be moved to the right or left on the touch screen 12 to adjust the sizes of the display areas 121, 122 correspondingly in respective to the movement of the finger simultaneously. For example, when the sideline 25 is moved to the left, the left side display area 121 becomes smaller while the right side display area 122 becomes larger, vice versa.

According to the preferred embodiment of the present invention, the applications running on the display areas 121, 122 respectively are configured to be operated via the input modules 22, 23 at the same time. For example, the user is able to play the game via the game application via the touch pad of the input module 22 by one hand and to chat with other user via the keyboard of the input module 23 by the other hand, such that the user does not have to switch between the applications to display on the display screen 12 or between windows opened on the display screen 12 to show on top of the other windows for operation.

Person skilled in the art would appreciated that tablet type electronic device 10 as shown in FIG. 5 would be a simulated electronic device projected from an AR/VR device 9 as shown in FIG. 3A. Or, alternatively, the tablet type electronic device 10 as shown in FIG. 5 would be interacted with an AR/VR device 9 as described above.

It is worth mentioning that, to the conventional computer, the user may merely operate one application at a time. For example, the user has to click on the icon shown on the control bar to open that window and then click on that window to activate that window so as to operate the application in that window. Or, the user may open two or more windows to show on the screen with different size at the same time, but the user must first click on the window selected in order to put that window on top of other windows and then click on that front window again to activate that front window so as to operate that activated window. However, according to the preferred embodiment of the present invention, as shown in FIGS. 5 and 6A-6D, the user may use both hands to operate the two or more applications on the two or more display areas 121, 122 independently and simultaneously at the same time. When more than one input devices are provided with the electronic device 10, such as keyboard, touch pad, voice input device such as microphone 142, and the like, each of the display areas 121, 122 will provide an input device selection bar thereon with icons of different input devices, so that the user may simply select the desired input device for operating the application running in that display area 121, 122 and make changes of the desired input device anytime. Accordingly, for example, the user may use the touch pad to operate the game running on one of the display area 121, and use the microphone 142 and speaker 144 to operate the chatting application running on the other display area 122.

In one embodiment, referring to FIG. 4B, the electronic device 10 further comprises a control panel 26 foldable coupled at the display screen 12 to form a laptop-like or notebook type computerized electronic device as shown in FIGS. 6A to 6C, wherein the electronic device illustrated by schematic drawings that merely shows the overall shape of the display the screen 12 and control panel 26 without illustrating the detail equipped elements such as storage cavity 111, microphone 142, speaker 144 and so on as shown in FIG. 3.

Referring to FIGS. 6A to 6C, the input modules 22, 23 are provided at the control panel 26 to independently control the applications displayed on the display areas 121, 122 of the display screen 12. Accordingly, the display screen 12 can be a touch display screen or a non-touch display screen. There are two or more sidelines 25 generated on the display screen 12 and the control panel 26 respectively. The sideline 25 formed at the display screen 12 is a visual sideline to separate the applications displayed on the display areas 121, 122 respectively while the sideline 25 formed at the control panel 26 is a control sideline to separate the input modules 22, 23 thereon.

It is noted that the control panel 26 can also be a touch screen and the two input modules 22, 23 are two display areas shown on the touch screen separated by the control sideline 25 on the control panel 26 too. Accordingly, the input devices such as keyboard and touch pad virtual images shown on the touch screen type control panel 26 as the input modules 22, 23.

Preferably, one of the input modules 22 is automatically or manually selected to match with one of the applications correspondingly, such as game application, and one of the input modules 23 is manually selected by the user to match with other applications.

In one example, the notebook type, tablet type or AR/VR type electronic device 10 is embodied as a portable game device for the user (player) to play games. The portable game device 10 for the entertainment industry can provide program functions through the sidelines 25, wherein the sidelines 25 do in conjunction and independent to the games or events that the user (operator) is participating to enhance the entertainment experience. In addition, game developers will have the total autonomy to include additional functions in their games or by just utilizing the existing program functions in the sidelines 25. In particular, the applications include at least a first application, for example a game application, and at least a second related application, for example a game related application. The game related application comprises different sideline programs. It is important that additional functions do not interfere with the sidelines programs because the programs functions in the sidelines 25 are independent of the games or the events being watch or play. It is important to understand the sideline programs are constantly running independent of the games or events running in the display areas 121, 122 of the display screen 12. The sidelines programs are fully operational when wagging or in used in an authorize event. It is also important to understand there is a symbiotic relation between all the sideline commands and the game display area 121 of the display screen 12 to provide a smooth flow of the games being played and of the events being watched. For example, the game/event display area 121, 122 will minimax or enlarge base on the operator sideline positioning. The user can also select multiple games/events viewings being controlled by the program. The types of games played in the game display area 121 or 122 may have unlimited futuristic capacities but they need to be approved by the establishment or facility like casino, theme park and etc., and the same is true for events being watched that they need to be approved by the establishment or facility. For examples, games like e-sport, ninja fruit and events like live sport bets, concerts and etc. The program is especially important when being utilized in a localize settings that, no matter if it is an hour event or a 4 year event, it is made for the communication of guest and the participation and enjoyment of the amenities in that establishment or facility.

Referring to FIGS. 6A to 6C, there are two sidelines 25 provided for every game, application or event, wherein one of the sidelines 25 is the visual sideline provided on the display screen 12 to divide it into the two display areas 121, 122 to display the game, application or event on the left display area 121 and the function program on the right display area 122, and the other sideline 25 is the control sideline provided on the control panel 26 to divide it into the two input modules 22, 23 for operating the game or event and the function program of the two display area 121, 122 respectively at the same time.

It is worth mentioning that the applications of the game or event and the function program displayed on the two display areas 121, 122 of the display screen 12 can be ran by the same processor 21 of the electronic device 10 or by more than one processors 21 of the electronic device 10 independently while at least one of the two processors 21 is configured to operate the positioning of the sidelines 25 in responsive to the operation and selection of the positions of the sidelines 25 as mentioned above. Of course, the applications can also be running and controlled by the server computer of the facility and the one or more processors 21 of the electronic device 10 is merely provided for communication, setting, computation, operating and controlling the control panel 26, data transmission between the electronic device 10 and the server computer of the facility via the networking system 20, and so on.

Both sidelines 25, i.e. the visual and control sidelines, are configured to be able to be moved such as by rolling up, down, right, or left for the users' choices according to their own personal selection. Both sidelines 25 (visual/control) can be configured and preset wide, narrow, short, or enlarge as well as provided with label words and audible. Both sidelines 25, including the visual and the control sidelines, can be in any setting independent of each other and will continue providing the programmable functions in each corresponding sideline programmable function, without interfering with the flow of the game or with the less distraction to the game. The program symbiotic relation between the sideline and the game screen on the respective display area 121, 122 will automatically give player the biggest game screen viewing field (at all times) base on the user's selection of size of the sideline 25.

Both sidelines 25, including the visual and the control sidelines, are configured to have interactive and artificial intelligence. The interactive sideline is color code, with or without audio effect from the speaker 142, to alert you to the most resent activated program. For example, the players have three program functions in the visual sideline 1) profiles, 2) alerts and 3) promotions. The player may select red for profiles, green for alerts and blue for promotions, so that as the player is playing, the program profile is activate inside the sideline 25 flashing red and the sideline 25 itself is also flashing red to indicate that the profile program has a match for the player to see the color code and/or to hear the audio effect. The same is provided for the control sideline too. For example, if the player has already seen a profile and has been communicating in the past and, while he is playing, the control sideline 25 turns red to indicated the resent text, voice, video or audio message a match profile has been send to the player.

It is also important to note that the inside to the sidelines 25 can also all be illuminated red in the same example. The interactive sidelines are program functions that do not change even if you change games or watching different events, unless the user edits his or her filter sideline settings to have different results generated by the programs. For example, editing different profiles functions will generate different profile matches. Also, editing a different service functions will generate different food selections, and etc. The same is true for all other program functions, or as many other program functions as the player selected in the sidelines 25. It is also important to understand the programs can be edit as a onetime change or as a permanent change.

The other interactive function of the sidelines is the audio program for all the programs in the sidelines 25 and not in the game display area of the display screen 12 or control screen of the control panel 26. The way it works is that, as the programs are working, the operator can select any or all programs on or off to be heard as they come on. For example, the user will see a profile color code message on screen in the visual sideline 25 at the same time the operator will hear it. The operator has the control to hear it louder than the games or events on both ears or on the right or left ear or softer (likewise). The same is true for the control sidelines programs. The operator will also be able to hear the message he or she are sending out or to read the messages shown in the display areas 121, 122.

According to the preferred embodiment of the present invention, the electronic device 10 of the present invention further comprises an artificial intelligence module 27 running by at least one of the one or more processors 21 as an intelligent user assistant for assisting the user to operate the sideline program, the first application and the second related application such as player ranking alerts, promotions, browsers, and other services. The artificial intelligence in the sideline 25 is the program that remembers your choices, likes and dislikes, and activities in the sideline programs, to include pass profile matches. Therefore, if next time you come and a match user was saved from last visit of the sideline programs will notify you and assist you with a record (text, video, or audio) of pass communication to remind the user (operator) and better assist you in communications. It may also remind you of food selection, activities and etc. It is also important to note that an operator may set the interactive and artificial intelligence module 27 to run automatically or off. The automatic setting saves everything and follows the user's pass choices if there is any history of past activity or learns from the user's current actions for the future. Also in the automatic settings, the program of the visual sideline 25 will active the control sideline programs into a symbiotic force reaction to incoming information and will automatically provide the tools to answer in the control sideline 25 and minimax or enlarge the game/event display area of the display screen 12. In the manual setting, users must select from novice, skillful, expert or master, and this will enable the operator adequate time.

It is appreciated that the user is always in control of both sidelines 25. The sidelines 25 are configured as a function of the program and so are the game being played or events being watched. The user can choice to add another game and play two games at the same time. He or she can determine the presentation of the games by moving the sidelines 25 and, furthermore, the user can select what game is displayed on top, bottom, right or left, up to twelve games. In other words, users can play up to six games at one time and continue using the program functions provided by the sidelines 25. The user accomplishes this task by dragging the games and events through the color coded sideline 25 from the browser inside the sideline 25. It is important to know that no matter the size of the sidelines 25, the user selects the program will automatically set the game screen of the display screen 12 and the control screen of the control panel 26 to the largest possible size. The user can set fix locations of the sidelines 25 to fix size to permanently expose all the program functions of the sideline 25 that he or she wishes to see, while at the same time the program maximizing the game/event screen size at all times.

This is not a picture in picture function to the main screen while this is a complex communicating interactive and artificial intelligence program, that enhances the games, program events, communications, and the entertainment of the events. The control sideline 25, when manually widen, reveals a (1) keyboard, (2) emojis, (3) panic bottom, and (4) control settings. The control sideline 25 that can also be fix to size to permanently expose the keyboard and other controls in the control sideline 25, while at the same time maximizing the control screen size of the control panel 26.

The program functions are in the sidelines 25 and these are the tools the device communicates with the players or users, with or without the less interference to the game screen of the display screen 12. The player or user has the control of which functions he or she wants to use on/off if any or all. For example, some functions in the visual sideline 25 are (1) ranking of players, (2) alerts, (3) promotions, (4) brows game/pop ups and (5) services. Once again, these programs functions have artificial intelligence. In other words, the electronic device 10 remembers and selects from past activities but will also remember both sidelines settings, so that the more the user plays or uses, the better the program works for the user. In these programs, the filter controls can also be changed by the players or users to get different selection options from the electronic device 10 as a one-time selection or as a permanent option.

Person skilled in the art would appreciated that tablet type electronic device 10 as shown in FIGS. 6A to 6C would be a simulated electronic device projected from an AR/VR device 9 as shown in FIG. 3A. Or, alternatively, the electronic device 10 as shown in FIGS. 6A to 6C would be interacted with an AR/VR device 9 to control and operate the games, programs and functions as described above. For example, the user can wear the AR/VR device 9 with the headset 911, receive sound from the speakers 912, give voice commands to control and operate the electronic device 10 as well as the sidelines 25 through the microphone 913, have augmented reality and/or virtual reality supported for the display screen 12 and the control panel 26 of the electronic device 10 from the AR device 914 and VR device 915, and/or give motion commands to control and operate the electronic device 10 as well as the sidelines 25 through by detecting motions of the user through the motion sensing device or camera 916.

It is worth mentioning that the sideline 25 may have two different computer languages operating on opposite sides of the sideline 25. For example, a computer programmer may select a game engine based on best graphics while another computer programmer may select a different computer language based on the program flexibility. It is appreciated that the sideline program controls are ergonomic human motions optimizing the most speed with the less effort conserving energy for prolong utilization. For example, touch point commands can be demanding in prolong repetition and are seriously near to impossible with muscular, and neurological tremer. It is important to mention that the sideline program is also voice commandable and user friendly. Programmable sideline controls the display of selected pop-ups programs and their location like incoming programs, communications, visual and voice alerts, with the less effort to the user and with the artificial intelligence that the more the user plays, the better the sideline program works for the user.

The ranking of player is a combination of programs that will provide multiple players a communication tool for the games/events that do not have a communication tools platform and will provide additional communication options to the game that have communication tools. In this arrangement, the electronic device 10 will save match of these profiles for you to rank while in a game/event.

The first tool is a (1) filter survey for player and the other facility guest. In other words, likes, dislikes and personality. (2) The other is a brief surrogate clip video, text, photos, audio, or any combination. (3) The next tool is a general video. (4) The next is a line of sight video this is when the electronic device 10 has physically been targeted because someone wants to contact you. In all these options, the electronic device 10 can save, delete and rank the other users after the main user has viewing the profiles. This will provide the electronic device 10 the ability to assisted the user with communications. The program will assist the user to communicate with the user's selected users as they become available in the ranked order the user provided.

Alerts will be set by the user's choice of phone numbers and emails the user wants to take. Emergency notice will be posted to override the game and the nature of the emergency. Promotions will have selected algorithms to generated gifts, coupons, and discounts to better reward the user and will also include advertisement. Services will range from booking restaurant, room services, operator, security, waiter, scheduling theme rides, GPS maps, event tickets, and etc.

In one example, the user is verified for the electronic device 10 in an authorized manner via the verification code to use the electronic device 10 as a portable game device within the private communication network, such as private casino communication network. The game application and the game related application are preloaded in the portable game device 10. Alternatively, the game application and the game related application are saved in a cloud storage that the game application and the game related application can be loaded in the portable game device 10 through Internet or Intranet. For example, once the portable game device 10 is wirelessly connected to the communication network, the game application and the game related application will be automatically loaded in the portable game device through the communication network.

It is worth mentioning that the user is able to download the game application and the game related application to his or her personal electronic device, such as a notebook, a tablet, a smart phone, or an AR/VR device, as the portable game device 10, and connect the personal electronic device to the communication network in order to play. The game application and the game related application are downloaded to the personal electronic device 10 and its screen is functioned as the display screen 12 and configured by the downloaded program to form the display areas 121, 122 by forming the visual sideline 25 in the display screen 12, wherein the game application and the game related application are displayed in the two display areas 121, 122 respectively. In addition, the keyboard or mouse pad can be used as the first input module 22 to control and operate the game application displayed on the display area 121, and the microphone 142 or another mouse connected thereto can be used the second input module 23 to control and operate the game related application displayed on the display area 122 at the same time.

Likewise, another personal electronic device can be wirelessly linked to the communication network by the electronic device 10 of the present invention in order to play game, such that the electronic device 10 of the present invention forms a communication link between the personal electronic device and the communication network.

In view of the electronic device 10 according to the preferred embodiment of the present invention, as shown in FIGS. 6A-6C, when the game application is loaded and displayed at the display area 121 of the display screen 12, the game related application is automatically loaded and displayed at the other display area 122 of the display screen 12. The first input module 22 will be automatically loaded at the control panel 26. For example, when the user selects to play the "Blackjack" electronic card game, a set of touch buttons are automatically configured at the first input module 22 of the control panel 26 for the user to select the betting amount, card drawing/holding selections, and etc. At the same time, the user is able to select one of the sideline programs of the game related application, such as chatting platform, intelligent user assistant, ranking, user profile, and etc. When the chatting platform is selected, the virtual keyboard as the second input module 23 will be automatically selected and displayed on the control panel 26. Therefore, the user is able to control (play) the electronic card game via the first input module 22 and to chat with other player users via the second input module 23 at the same time. It is worth mentioning that the user is able to select different input modules 23, such as voice input, keyboard, motion detecting input, mouse input, touch pad, touch screen input, holograph control activation, and etc., for the game related application. In addition, other player users who play the same game will be automatically shown in the chatting platform, such that the user is able to chat with other player users at the same time when he or she plays the game.

Accordingly, the phone connection station 11 is adapted for connecting with the user smart phone. The player verification module 44 comprises a verification program application to generate a verification code in order to activate the electronic device 10 and also to execute the user smart phone settings and preferences downloading to the electronic device 10 automatically. In other words, the smart phone program applications is a set up version for the continue continuity of use on to the portable electronic devices 10, for the user to use with and without the portable electronic device 10

As shown in FIG. 6A, the display screen 12 is split by the visual sideline 25 into the two display areas 121, 122, such as left display area and right display area. The game application, such as an electronic tic-tac-toe game, is selected and executed on one of the display areas 121, 122, for example the left display area 121. The related game application, including different program selections such as profile, alert, promotions, and browsing, is displayed on the other display areas, i.e. the right display area 122, for the user to select. At the same time, the first input module 22 is automatically loaded as a set of directional buttons and selection buttons on the control panel 26 and the second input module 23 is automatically loaded as a virtual keyboard on the control panel 26. It is worth mentioning that the first and second modules 22, 23 are separated by the control sideline 25 on the touch screen type control panel 26. Therefore, the user is able to play the game via the first input module 22 by the left hand of the user and to select one of the program selections via the second input module 23 by the right hand of the user at the same time. The electronic device 10 is configured to enable user to select the positions of the first input module 22 and the second input module 23 that the user is convenient to control and operate the game application and the game related application displayed on the left and right display areas 121, 122 of the display screen 12 respectively at the same time. For example, if the game application is displayed on the left display area 121, it may be more convenient to set the first input module 22 configured to control and operate the game application on the left side of the control panel 26 too while the second input module 23 is set to position on the right side of the control panel 26 to control and operate the game related application displayed on the right display area 122 of the display screen 12. Of course, it is free for the user to configure according to his or her convenient and desire.

As shown in FIG. 6B, an alternative mode of the above preferred embodiment of the present invention is illustrated, wherein the display screen 12 is embodied as the bottom touch screen panel and the control panel 26 is embodied as the upper touch screen panel. Person skilled in the art may already understand that the positions of the display areas 121, 122 and the input modules 22, 23 are preferably configured to be interchangeable or set according to the desire of the user, especially when both the display screen 12 and the control panel 26 are touch screen panels. Some users may prefer to have the game application and its input module 22 displayed on, for example, the bottom touch screen panel and the game related application and its input module 23 displayed on, for example, the upper touch screen panel of the electronic device 10. In other words, the electronic device 10 is preferably programmed to be capable of interchanging the positions of the applications and their input modules on the screen panels anytime by setting and configuring them.

FIG. 6C illustrates another alternative mode of the above preferred embodiment of the present invention, wherein the display screen 12 is divided into three display areas 121, 122, 123 by a vertical virtual sideline and a horizontal virtual sideline, while the control panel 26 is divided into three input modules 22, 23, 24 by a vertical control sideline and a horizontal control sideline 25 accordingly to control and operate a total of three applications displayed on the three display areas 121, 122, 123 respectively at the same time. As mentioned above, the sidelines 25 are all configured to be movable by such as rolling upwards, downwards, leftwards, or rightwards to adjust the relative sizes of the display areas 121, 122, 123 and the input modules 22, 23, 24 anytime. In other words, the electronic device 10 according to the preferred embodiment of the present invention enables the user to select the number of display areas provided on the display screen 12 and input modules provided on the control panel 26 by selecting the number and positions of the virtual sidelines 25 configured on the display screen 12 and the control sidelines 25 configured on the control panel 26.

It is worth to further mention that the surrounding rims of the frame of the display screen 12 and the control panel 26 can also be made to form illuminating rims so as to provide lighting effect of different colors as well as flashing with respect to the game(s) playing with the electronic device 10 to enhance the game effect, indication and entertainment experience. Also, the sound effect from the speaker, the incoming alerts, the sideline programs and the panic button may be corresponding to the lighting effect to strengthen the indication of "ON" status of the electronic device 10 for enhancing entertainment experience.

Figure 7:
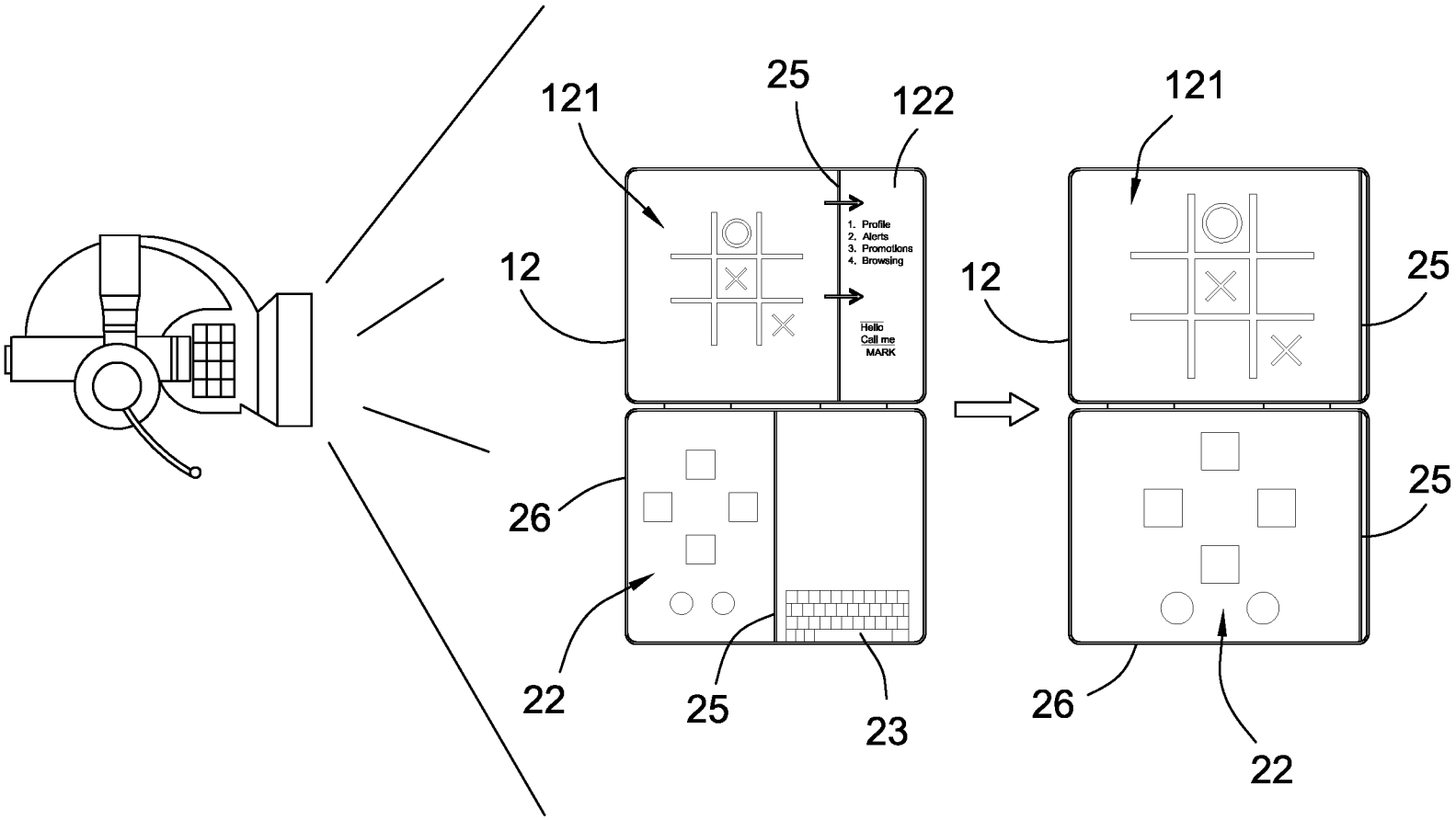
FIG. 7 illustrates the size adjustment of each of the display areas via the movement of the sideline according to the preferred embodiment of the present invention.

As described above, the user is able to move the visual sideline 25 to adjust the size of each of the display areas 121, 122. In particular, the user is able to preset that when the visual sideline 25 is moved, the control sideline 25 will be moved correspondingly. Referring to FIG. 7, for example, when the visual sideline 25 is moved to the right direction, the control sideline 25 can be preset to be moved correspondingly to the right direction too. Preferably, when the visual sideline 25 is moved to the one boundary edge of the display screen 12, the corresponding display area 121, 122 will be minimized. For example, when the visual sideline 25 is moved to the right boundary edge of the display screen 12, the right display area 122 will be disappeared, such that only the game application will be displayed on the display screen 12. Correspondingly, the second input module 23 will be closed at the same time.

Figure 8B:
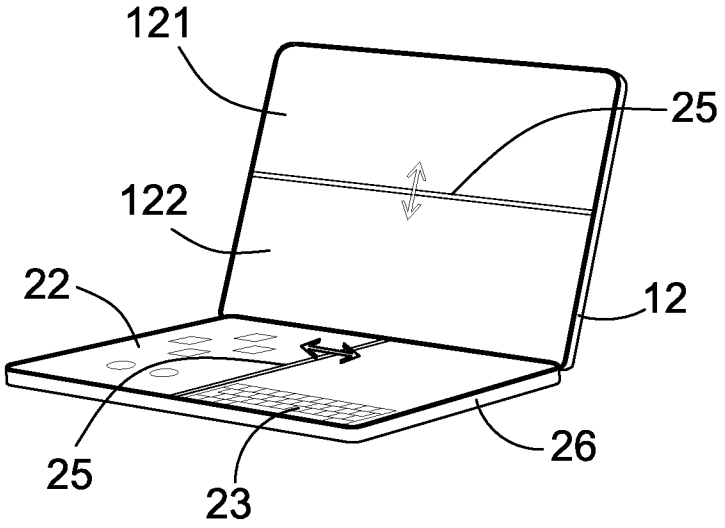
FIGS. 8A to 8C illustrate different sideline configurations of the electronic device and how to reset or reposition the sidelines of the electronic device according to the preferred embodiment of the present invention.
Figure 8A:
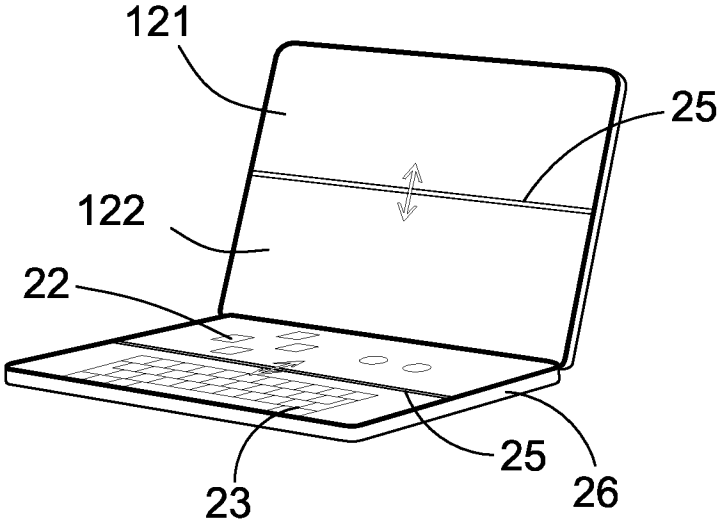
Figure 8C:
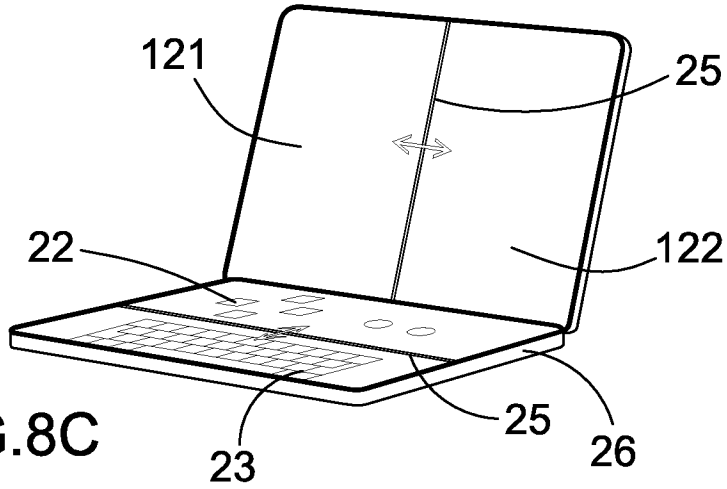

In addition, the visual and control sidelines 25 can be selectively configured by the user as shown in FIGS. 8A to 8C to either form as a vertical sideline or horizontal sideline. Referring to FIG. 8A, the virtual sideline 25 is set to be a horizontal sideline on the display screen 12 to divide into an upper display area 121 and a lower display area 122 while the control sideline 25 is also set to be a horizontal sideline on the control panel 26 that divides the control panel into an upper input module 22 and a lower input module 23, wherein the user may select and set one of the upper and lower input modules 22, 23, for example the upper input module 22, to control and operate the upper display area 121 and the other input module, for example the lower input module 23 controls and operates the other display area 122, vice versus.

FIGS. 8B and 8C illustrate the virtual and control sidelines 25 can also be configured and set in opposite manner, wherein the electronic device 10 is illustrated by schematic drawings that merely shows the overall shape of the display screen 12 and control panel 26 without illustrating the detail equipped elements such as storage cavity 111, microphone 142, speaker 144 and so on as shown in FIG. 3.

It is worth mentioning that the virtual and control sidelines 25 and the sideline program thereof are illustrated with a physical appearance of a segment line with artificial intelligent on the screens, such as the display screen 12 and the control panel 26, which can have additional shapes for creativity like oblique and/or circular positions to enhance the nature of the programs. Person skilled in the art should understand that the sidelines 25 can also be modified as simulated sidelines illustrated via the AR/VR device 9 that the user can view and operate the simulated sidelines 25 through the AR/VR device 9, and that the display screen 12 and/or control panel 26 can also in oblique or circular shape. In addition, when the display screen 12 of the electronic device 10 or the AR/VR device 9 is able to provide three-dimensional screen, the sideline 25 can also function as a panel dividing a closer portion and a deeper portion of the 3-D screen.

As shown in FIG. 8B, according to the preferred embodiment of the present invention, the virtual sideline 25 on the display screen 12 is set as a horizontal sideline to divide the display screen 12 into an upper display area 121 and a lower display area 122, and the control sideline 25 of the control panel 26 is set a vertical sideline to form a left input module 22 and a right input module 23 on the control panel 26. The user may select one of the left and right input modules 22, 23, for example the left input module 22 to control and operate the upper display area 121 while the other input module, for example the right input module 23 to control and operate the lower display area, vice versus. As shown in FIG. 8C, the virtual sideline 25 on the display screen 12 is set as a vertical sideline to divide the display screen 12 into a left display area 121 and a right display area 122, and the control sideline 25 of the control panel 26 is set a horizontal sideline to form an upper input module 22 and a lower input module 23 on the control panel 26. The user may select one of the upper and lower input modules 22, 23, for example the upper input module 22 to control and operate the left display area 121 while the other input module, for example the lower input module 23 to control and operate the right display area, vice versus.

Figure 9B:
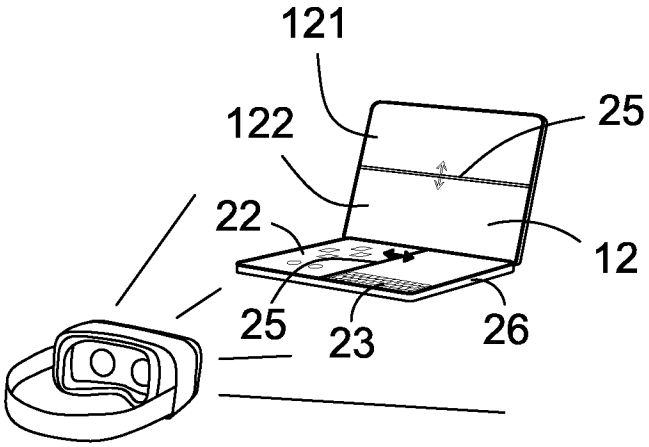
FIGS. 9A to 9C illustrate the electronic device interacting with the AR/VR device according to the above preferred embodiment of the present invention.
Figure 9A:
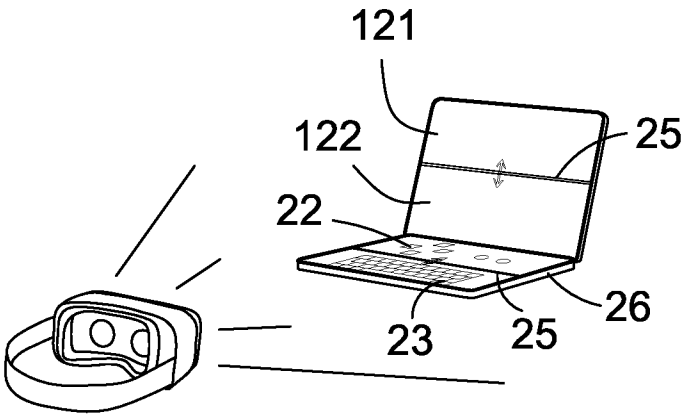

According to the preferred embodiment of the present invention, in order to resetting or repositioning of the sideline 25 parallelly, as show in FIG. 9A, the user may simply use his or her finger, for example, double clicking or touching and holding for a predetermined period of time on any of the sideline 25 to activate that sideline 25 to movable status, and then the user may use a finger to touch and hold that sideline 25 to slide to the desired position. When the user removes his or her finger from that sideline 25 at the new position, after a predetermined period of time, such as three seconds, that sideline 25 will stay at that new position. Similarly, when the control panel 26 is a touch screen, the parallel resetting or repositioning the sideline 25 separating the input modules 22, 23 on the control panel 26 can also be changed or reset by the above "T" setting method too.

To reset or change the orientation of the sideline 25, such as from a horizontal sideline to a vertical sideline or from a vertical sideline to a horizontal sideline, there are multiple ways being able to program. For example, the change of the orientation of any desired point of the sidelines 25 can be done by a "T" setting method, wherein referring to FIGS. 9B and 9C, the user may simply use his or her finger, for example, to draw a first setting line 31 from the sideline 25 and generally perpendicular to the sideline 25, and then draw second setting line 32 across the first setting line 31 and generally parallel to the sideline 25 to form a "T" setting FIG. 30. After a certain period of time, the original sideline 25 disappears and a new sideline 25 is formed to substitute the original sideline 25 at the position of the first setting line 31 and the "T" setting FIG. 30 disappears too. Therefore, the orientation of the sideline 25 changes perpendicularly.

Figure 9C:
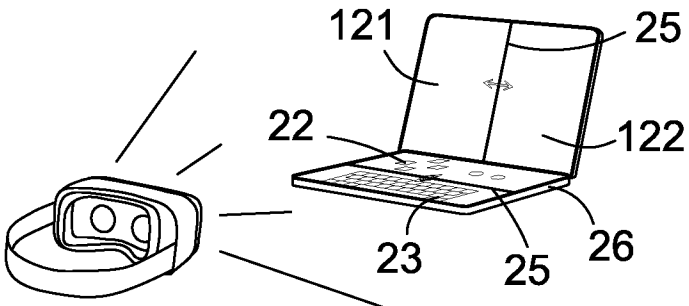

For example, a horizontal sideline 25 is reset and changed to a vertical sideline 25 as shown in FIG. 9B, wherein the first application and second related application displayed on the upper and lower display areas 121, 122 originally will be displayed on the left and right display areas 121, 122 separated by the new vertical sideline 25, if the default setting is preset to upper-to-left and lower-to-right format, or alternatively, upper-right and lower-left format. Or, a vertical sideline 25 is reset and changed to a horizontal sideline 25, as shown in FIG. 9C, wherein the first application and second related application displayed on the left and right display areas 121, 122 originally will be displayed on the upper and lower display areas 121, 122 separated by the new horizontal sideline 25, if the default setting is preset to left-to-upper and right-to-lower format by the user in the electronic device 10. Of course, alternatively, the default setting preset to right-to-upper and left-to-lower format by the user. Similarly, when the control panel 26 is a touch screen, the orientation change of the sideline 25 separating the input modules 22, 23 on the control panel 26 can also be changed or reset by the above "T" setting method too.

FIGS. 9A to 9C illustrate that the electronic device 10 as shown in FIGS. 8A to 8C can also be interacting with the AR/VR device 9 as shown in FIG. 3A, wherein the user can wear the AR/VR device 9 with the headset 911, receive sound from the speakers 912, give voice commands to control and operate the electronic device 10 as well as the sidelines 25 through the microphone 913, have augmented reality and/or virtual reality supported for the display screen 12 and the control panel 26 of the electronic device 10 from the AR device 914 and VR device 915, and/or give motion commands to control and operate the electronic device 10 as well as the sidelines 25 through by detecting motions of the user through the motion sensing device or camera 916.

Figure 11:
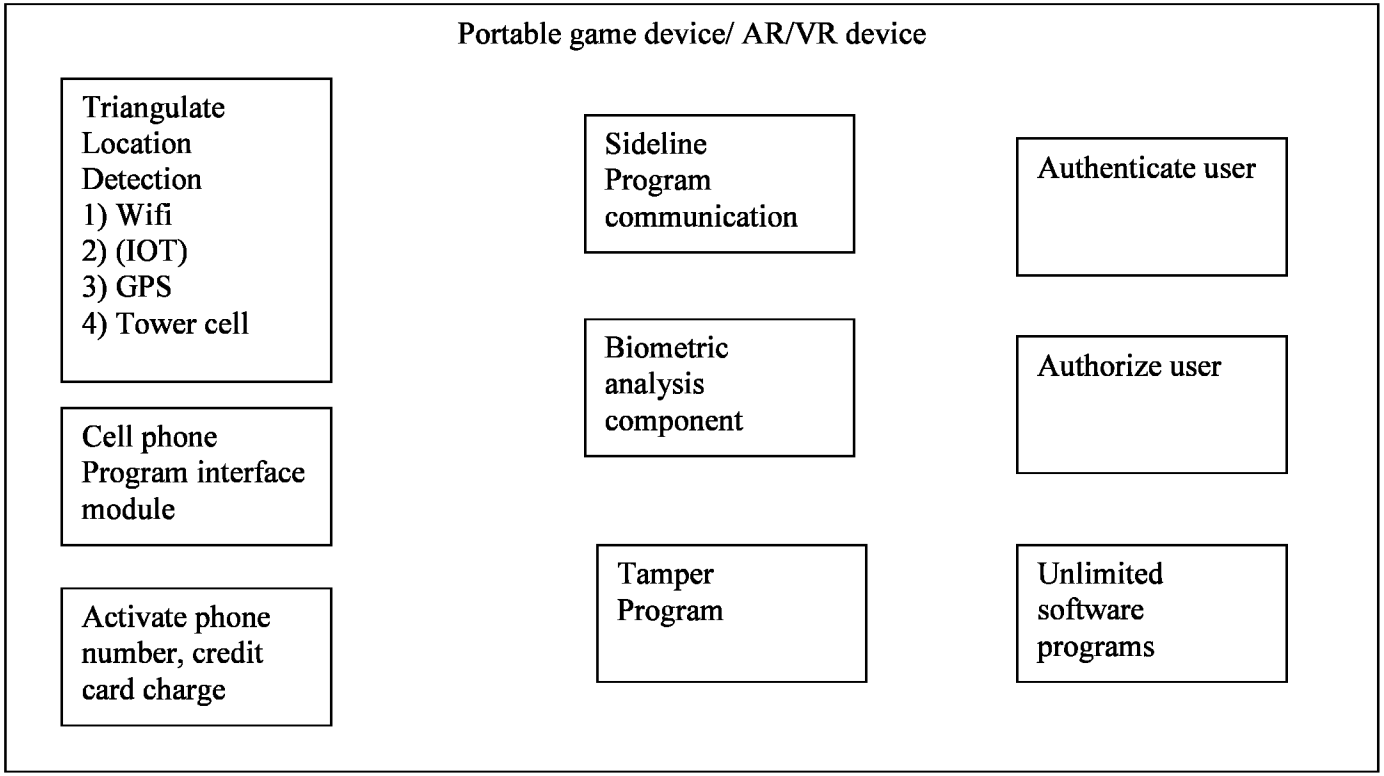
FIG. 11 is a block diagram illustrating the interacting of the electronic device and the AR/VR device according to the preferred embodiment of the present invention.
Figure 12:
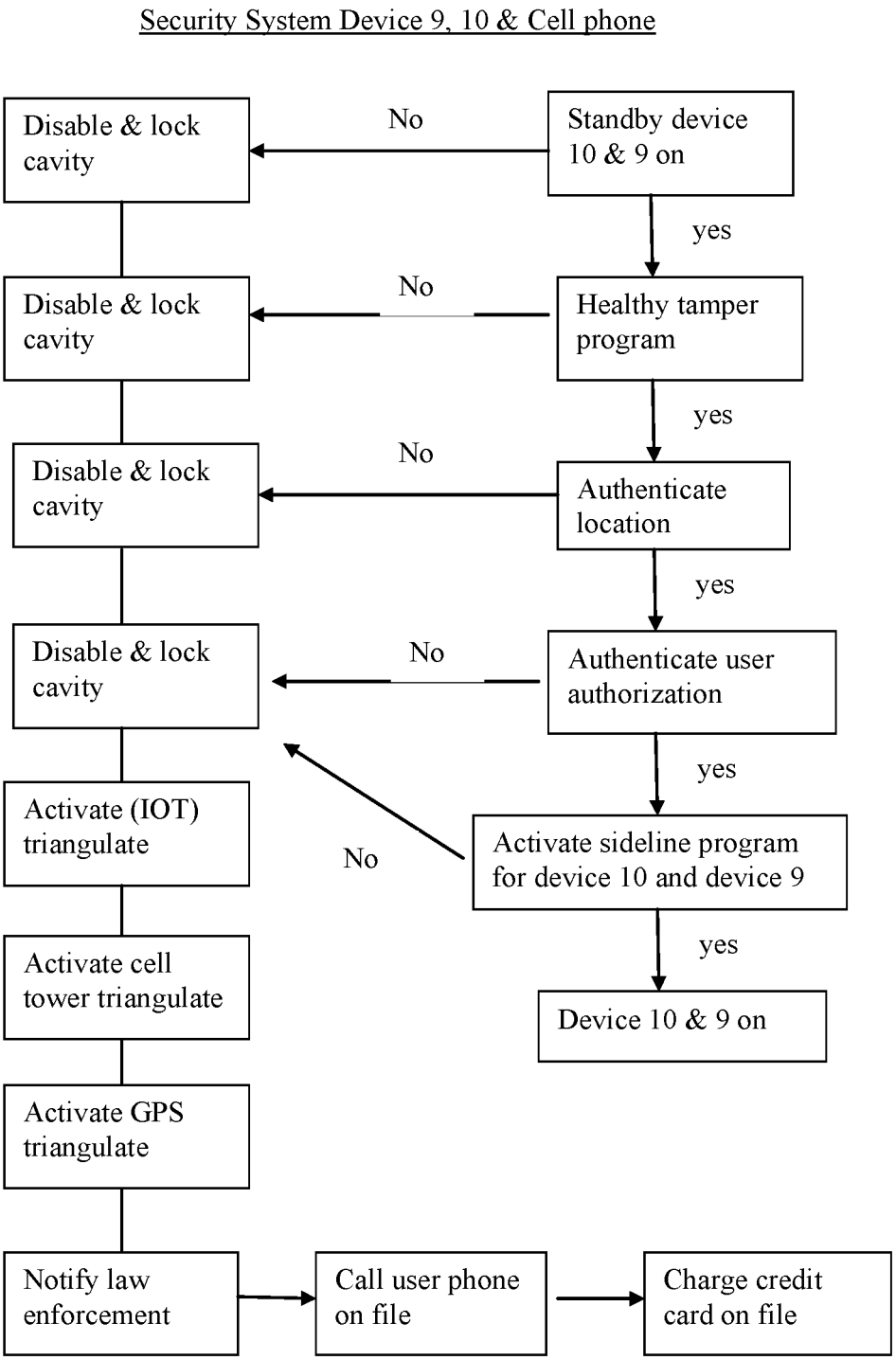
FIG. 12 is a schematic diagram illustrating the arrangement of the multi-task interactive electronic device and AR/VR device according to the preferred embodiment of the present invention.
Figure 13:
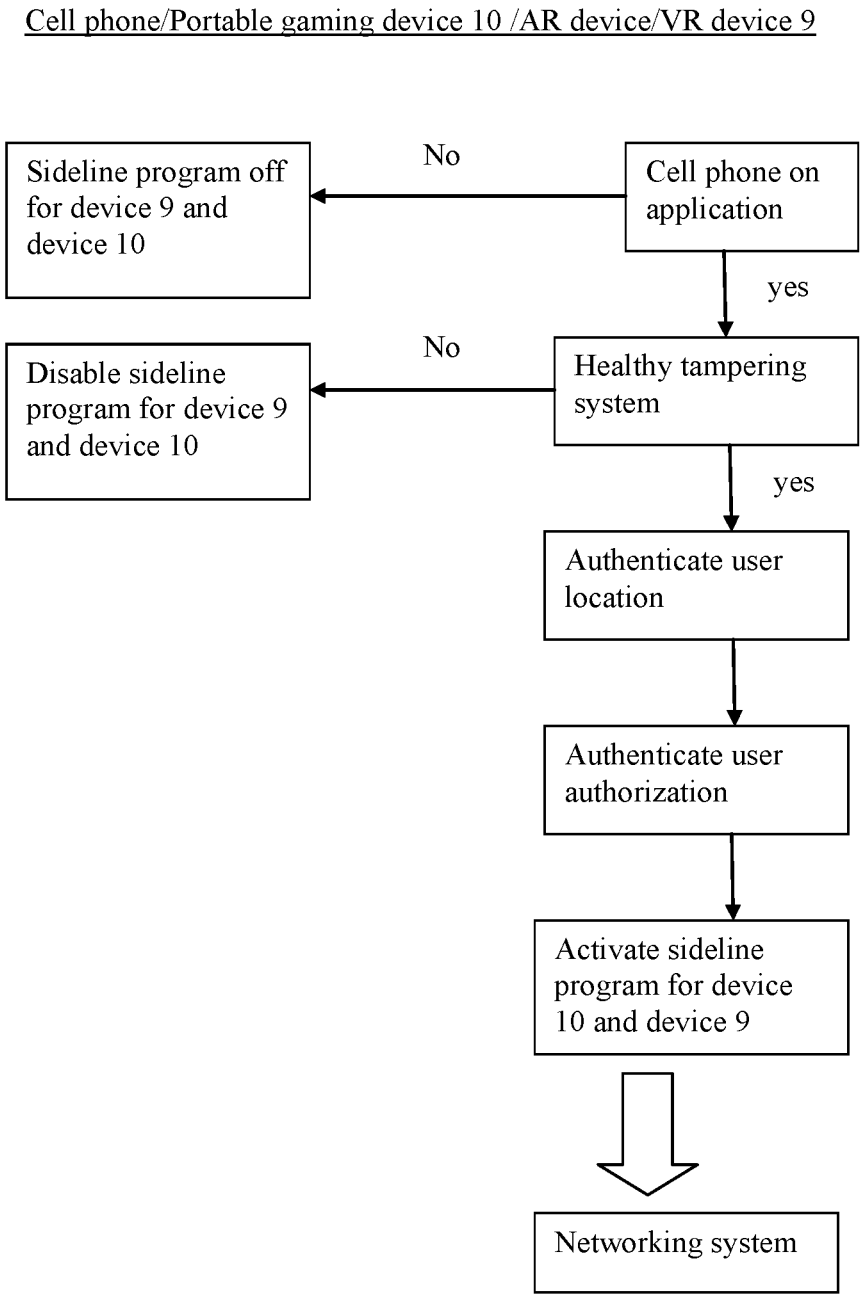
FIG. 13 is a flow chart illustrating the interacting of the smart cellular phone, the gaming electronic device and the AR/VR device according to the preferred embodiment of the present invention.

In particular, referring to FIGS. 11-13, the AR/VR device 9 can be interacts with electronic device 10 and the players or users. The player may see the display screen 12 and the control panel 26 and interact with the sidelines supported by the sideline program in the AR/VR device 9 for controlling and operating the game in the electronic device 10. The user of the AR/VR device 9 is able to slide the sidelines 25 the same as in the physical portable electronic device 10. Through the AR/VR device 9, the user may also be able to command through hand, finger, pupil, head motion, and voice command. The gaming electronic device 10, sideline program in the AR/VR device 9 and the smart phone of the user are interacted with each other forming the arrangement of operating multi-task interactive electronic devices of the present invention.

The AR/VR device 9 may also replace the physical portable gaming electronic device 10 by simply projecting an image as a simulated electronic device that also interacts with the sideline program and the smart phone of the user. In one embodiment, the AR/VR device 9 can be activated with the same security requirements for the sideline program by combination of the smart phone and the security system while maintaining the same disable function for the security tampering system as mentioned above for the physical portable gaming electronic device.

In one embodiment, the game program can be seen in the eye/head set of the AR/RV device 9 and the functions of the game are controlled in the AR/VR device 9 by the sideline program or vice versa. The player can have multiple sidelines 25 operating in the gaming electronic device 10 and in the AR/VR device 9 vice versa. The sideline program for the gaming electronic device 10 and the AR/VR device 9 can both be activated by voice command. In addition, the motion sensing camera 145 or 916 on the back side of the display screen 12 or on the back posterior occipital region of the AR/VR device 9 can provide the user a surround motion view of his/her location in the AR/VR device 9. The gaming electronic device 10 can provide the AR/VR user surround sound and the ability for the user to also have a 360 view in his/her AR/VR device 9 through the use of the sideline program while the user is entertaining. The user is able to select what he or she wants to see on the display screen 12 of the electronic device 10 and what he or she wants on the AR/VR device 9 to include alert, message, game, confreres, amenities, and etc. In addition, the AR/VR device 9 may have the panic button 901 just like the gaming electronic device 10.

In one embodiment, the AV/RV device 9 can be activated by the smart phone and or the gaming electronic device 10 and vice versa. In another embodiment, the smart phone, portable gaming electronic device 10 and the AR/VR device 9 once being activated can up load and down load into other interacting device(s) after the AV/RV device 9 and other portable gaming electronic devices 10 as a form of convenience without additional step in the sideline program security or may only be operated in a one AR/VR device to one gaming electronic device system as a form to added security. The AR/VR device 9 may or may not continue to need the smart phone application authorization. The AR/VR device 9 is able to interact with the hologram while the light projection motion controls will provide the user the best entertainment of his/her life. For example, the AR user can have the holograph/light projection in the gaming electronic device 10 to provide an additional magical ambience as the user is playing on the gaming electronic device 10 in the AR device and, with the portable gaming electronic device 10, the user can also use the touch screen in the VR device or vice versa. In another embodiment, as the panic button 901 is armed on the AR/VR device 9, the hologram and light projection on the gaming electronic device 10 will identify the location of the user to first responders. The AR/VR device 9 is an all-in-one device that the virtual reality (VR) can be control through the touch screen (display screen 12 and control panel 26) of the portable gaming electronic device 10 or not. The VR device can also be removed and the AR device will activate in addition while the AR device can be turn off. Furthermore, the head set 911 of the AR/VR device 9 can continue provide the user a surround sound system and microphone interaction with the electronic portable electronic device 10.

Figure 10A:
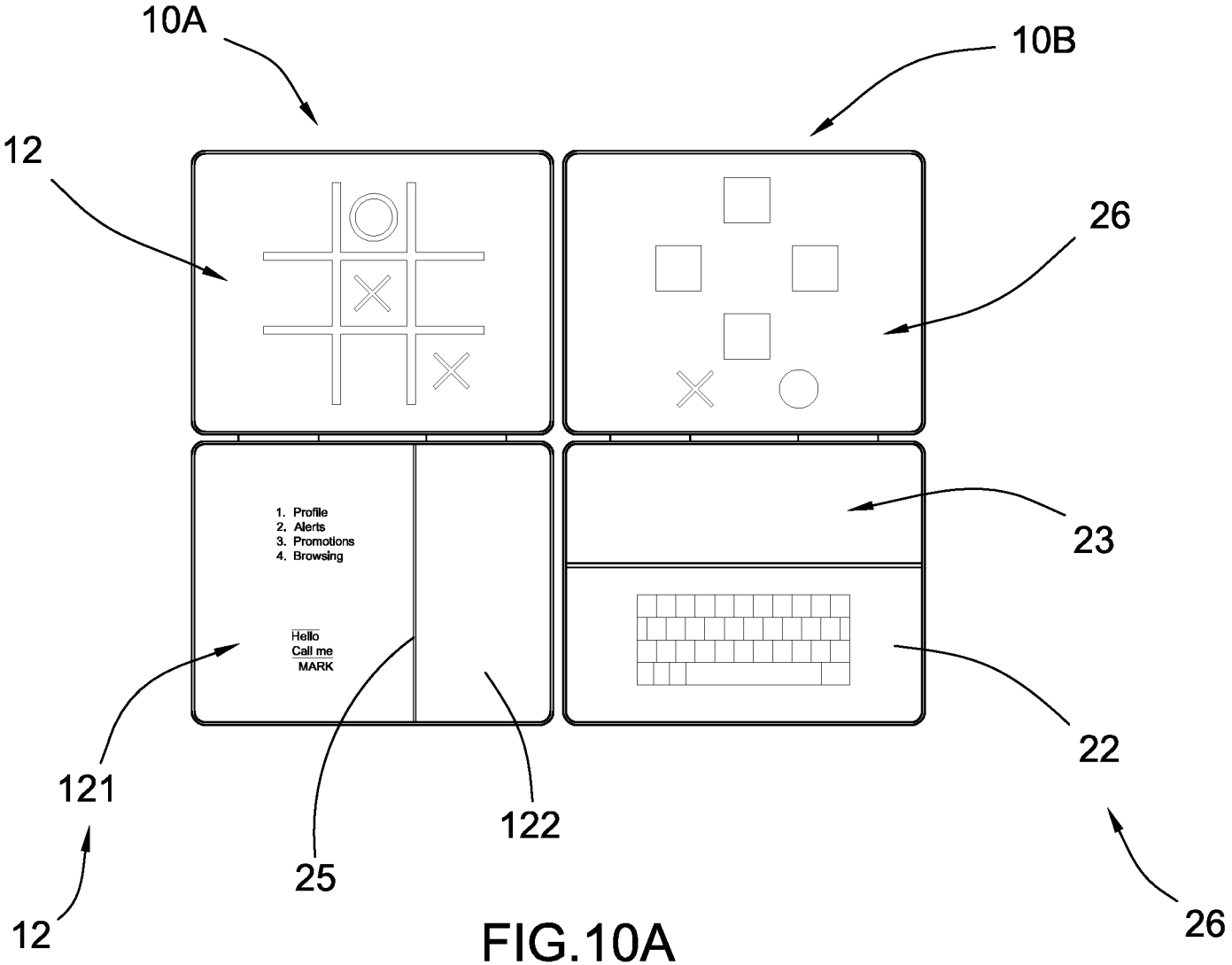
FIGS. 10A and 10B illustrate the usage of two electronic devices together according to the preferred embodiment of the present invention.

It is appreciated that the electronic device 10 according to the preferred embodiment of the present invention is programmed to be able to be used with at least another electronic device 10 together. Referring to FIG. 10A, a first electronic device 10A and a second electronic device 10B are used side by side together and the user is able to configure them into an arrangement and link with the facility through the communication network, wherein four touch screens are present to arrange the display areas and input modules. The user may set the two touch screens of the electronic devices 10A as two display screens 12 and the two touch screens of the electronic devices 10B as two control panels 26 to control and operate the first application and the second related application displayed on the two display screens 12 of the electronic device 10A respectively. One or more sidelines 25 are also able to use to separate each of the two display screens 12 into two or more display areas 121, 122 and each of the two control panels 26 into two or more input modules 22, 23 to control and operate the games or applications displayed on the display areas 121, 122 respectively.

Figure 10B:
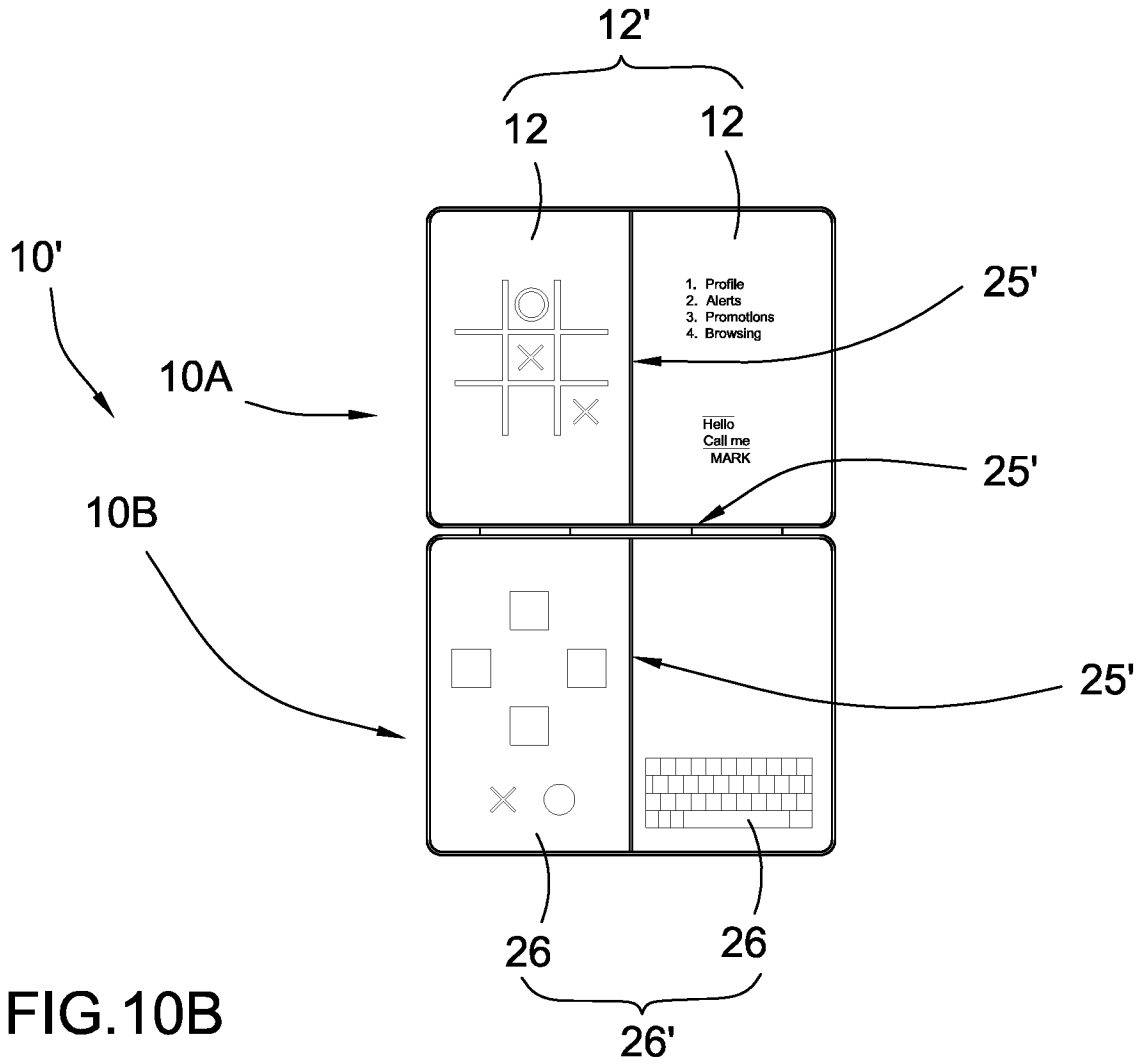

Referring to FIG. 10B, the first and second electronic devices 10A and 10B can be hinged together to form a single portable electronic device 10' with two display screens 12 and two control panels 26. Accordingly, the two display screens 12 can be configured to form a combined display screen 12' and the two control panels 26 can be configured to form a combined control panel 26' and the boundary between the two electronic devices 10A and 10B is set as sidelines 25' of the combined display screen 12' and the combined control panel 26' respectively.

It is worth mentioning that when the electronic device 10 is embodied as or interacted with the AV/VR device 9, the user is preferred to be educated or explained for how the sideline program and the sidelines operated with the AR/VR projections from the AV/VR device 9 that the user may view.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An arrangement of operating multi-task interactive game devices, comprising one or more games devices linked through a networking system, wherein each of said game devices comprises:

at least a processor that executes at least a game application and a game related application with different interactive programs at the same time;

a screen module operatively linked to said processor, wherein said screen module comprises at least a display screen having two or more display areas for displaying said game application and said game related application thereon respectively; and two or more input modules operatively linked to said processor, wherein said game application and said game related application are simultaneously controlled and operated by said input modules respectively, wherein said game application and said game related application are executed to be displayed on said display areas respectively and are independently controlled by said input modules at the same time for enabling a user to process of said game application via one of said input modules and operate said game related application at the same time via another said input module without interfering said game application;

a control module which generates one or more sidelines to be displayed on said display screen to split said display screen into said two or more display areas, wherein said game application, said game related application, and said input modules are displayed on said display areas that said game application and said game related application are displayed on said display areas respectively while said input modules are displayed on said display areas respectively; and a control panel foldable coupled with said display screen, wherein said input modules are provided at said control panel to independently control said game application and said game related application displayed on said display area of said display screen, wherein one or more sidelines are generated on said control panel to split said control panel into two or more control areas according to the position of each of display areas, wherein said two or more control areas and two or more display areas are axial symmetry based on the connection portion between said screen module and said control panel, wherein said sidelines formed on said control panel is a control sideline to separate said input modules thereon.

2. The arrangement, as recited in claim 1, wherein said sideline is movable on said display screen to split said display screen into two or more said display areas so as to adjust a size of each of said display areas correspondingly.

3. The arrangement, as recited in claim 2, wherein at least one of said sidelines is generated as one of a horizontal sideline and a vertical sideline being movable on said display.

4. The arrangement, as recited in claim 2, wherein said display screen is a touch screen that said game application, said game related application, and said input modules are displayed on said touch screen, wherein only one said sideline is formed on said touch screen to split said display screen into two said display areas that said game application and said corresponding input module are displayed one of said display areas while said game related application and said corresponding input module are displayed on another said display area.

5. The arrangement, as recited in claim 2, wherein said control module further comprises a color code generator that generates different color codes for said sideline to indicate said different interactive programs of said game related application.

6. The arrangement, as recited in claim 1, wherein said control panel is a touch screen, such that said input modules are displayed on said control panel.

7. The arrangement, as recited in claim 6, wherein at least one of said input modules is automatically selected to match with said game application and at least one of said input modules is manually selected by the user to match with said game related application.

8. The arrangement, as recited in claim 1, further comprising an artificial intelligence module run by said processor as an intelligent user assistant for assisting the user to operate said game related application which is selected from a group consisting of player ranking alerts, promotions, browsers, and services.

9. The arrangement, as recited in claim 1, further comprising a verification module, which is executed by said processor, for verifying the user to access said game application in an authorized manner.

10. The arrangement, as recited in claim 9, further comprising a phone connection station for connecting with a user smart phone of the user, wherein said verification module comprises a verification program application to generate a verification code in order to activate said system and also to executed the user smart phone settings and preferences down to said system automatically.

11. The arrangement, as recited in claim 1, further comprising a closed communication network module being executed by said processor for wirelessly linking to a private networking system, wherein said game application is restricted for being accessed only through said private networking system.

12. The arrangement, as recited in claim 1, further comprising a positioning unit for detecting a location of said game device, wherein said game device is restricted for being accessed in limited locations within a facility area of a facility in a real-time manner and is disabled for being tampered or being removed outside a working area of said facility via said positioning unit.

13. The arrangement, as recited in claim 1, further comprising a chatting module, wherein said game related application comprises a chatting application being executed for enabling the user to chat with another user of another device via said chatting module when the users play said game application at the same time.

14. The arrangement, as recited in claim 1, wherein said game application and said game related application are preloaded in said game device.

15. An electronic device for multi-task interactive operation with one or more other electronic devices through a networking system, wherein said electronic devices comprises:

at least one processor that executes at least a first application and a second related application with different interactive programs at the same time;

a screen module operatively linked to said processor, wherein said screen module comprises at least a display screen having two or more display areas for displaying said first application and said second related application thereon respectively; and two or more input modules operatively linked to said at least one processor, wherein said first application and said second related application are simultaneously controlled and operated by said input modules respectively, wherein said first application and said second related application are executed to be displayed on said display areas respectively and are independently controlled by said input modules at the same time for enabling a user to process of said first application via one of said input modules and operate said second related application at the same time via another said input module without interfering said first application;

a control module which generates one or more sidelines to be displayed on said display screen to split said display screen into said two or more display areas, wherein said first application, said second related application, and said input modules are displayed on said display areas that said first application and said second related application are displayed on said display areas respectively while said input modules are displayed on said display areas respectively; and a control panel foldable coupled with said display screen, wherein said input modules are provided at said control panel to independently control said game application and said game related application displayed on said display area of said display screen, wherein one or more sidelines are generated on said control panel to split said control panel into two or more control areas according to the position of each of display areas, wherein said two or more control areas and two or more display areas are axial symmetry based on the connection portion between said screen module and the said control panel, wherein said sidelines formed on said control panel is a control sideline to separate said input modules thereon.

16. The electronic device, as recited in claim 15, wherein said sideline is movable on said display screen to split said display screen into two or more said display areas so as to adjust a size of each of said display areas correspondingly.

17. The electronic device, as recited in claim 16, wherein at least one of said sidelines is generated as one of a horizontal sideline and a vertical sideline being movable on said display screen.

18. The electronic device, as recited in claim 16, wherein said display screen is a touch screen that said first application, said second related application, and said input modules are displayed on said touch screen for interaction, wherein only one said sideline is formed on said touch screen to split said display screen into two said display areas that said first application and said corresponding input module are displayed one of said display areas while said second related application and said corresponding input module are displayed on another said display area.

19. The electronic device, as recited in claim 16, wherein said control module further comprises a color code generator that generates different color codes for said sideline to indicate said different interactive programs of said second related application.

20. The electronic device, as recited in claim 15, wherein said control panel is a touch screen, such that said input modules are displayed on said control panel.

21. The electronic device, as recited in claim 20, wherein at least one of said input modules is automatically selected to match with said first application and at least one of said input modules is manually selected by the user to match with said second related application.

22. The electronic device, as recited in claim 15, further comprising an artificial intelligence module run by said processor as an intelligent user assistant for assisting the user to operate said second related application.

23. The electronic device, as recited in claim 15, further comprising a verification module, which is executed by said processor, for verifying the user to access said first application in an authorized manner.

24. The electronic device, as recited in claim 23, further comprising at least a phone connection station for connecting with a user smart phone of the user, wherein said verification module comprises a verification program application to generate a verification code in order to activate said sidelines and also to executed the user smart phone settings and preferences of said sidelines down to said electronic devices automatically.

25. The electronic device, as recited in claim 15, further comprising a closed communication network module being executed by said processor for wirelessly linking to a private networking system, wherein said first application is restricted for being accessed only through said private networking system.

26. The electronic device, as recited in claim 15, further comprising a positioning unit for detecting a location of said electronic device, wherein said electronic device is for being accessed in limited locations within a facility area of a facility in a real-time manner and is disabled for being tampered or being removed outside a working area of said facility via said positioning unit.

27. The electronic device, as recited in claim 15, wherein said first application and said second related application are preloaded in said electronic device.

* * * * *